US010220859B2

(12) United States Patent
Reese et al.

(10) Patent No.: US 10,220,859 B2
(45) Date of Patent: Mar. 5, 2019

(54) ZIP LINE ASSEMBLY AND TROLLEY THEREFORE

(71) Applicant: Miracle Recreation Equipment Company, Monett, MO (US)

(72) Inventors: Lloyd W. Reese, Farmington, MO (US); James A. Hughes, Monett, MO (US)

(73) Assignee: Miracle Recreation Equipment Company, Monett, MO (US)

( * ) Notice: Subject to any disclaimer, the term of this patent is extended or adjusted under 35 U.S.C. 154(b) by 227 days.

(21) Appl. No.: 15/335,063

(22) Filed: Oct. 26, 2016

(65) Prior Publication Data

US 2017/0120935 A1 May 4, 2017

Related U.S. Application Data

(60) Provisional application No. 62/247,580, filed on Oct. 28, 2015.

(51) Int. Cl.
*A63G 9/04* (2006.01)
*A63G 9/12* (2006.01)
(Continued)

(52) U.S. Cl.
CPC ..... *B61B 12/00* (2013.01); *A63G 9/04* (2013.01); *A63G 9/12* (2013.01); *A63G 21/20* (2013.01); *B61B 3/00* (2013.01)

(58) Field of Classification Search
CPC .. B61B 3/00; B61B 12/00; A63G 9/00; A63G 9/04; A63G 9/12; A63G 21/20
See application file for complete search history.

(56) References Cited

U.S. PATENT DOCUMENTS 3,880,087 A * 4/1975 Pamer ..... B61B 13/04 104/123
4,270,872 A * 6/1981 Kiyosawa ..... F16B 7/0446 403/170
(Continued)

FOREIGN PATENT DOCUMENTS

EP 0291617 A1 11/1988
FR 649181 12/1928
(Continued)

OTHER PUBLICATIONS

Extended European Search Report for corresponding European Application 16196314, dated May 9, 2017.
(Continued)

*Primary Examiner* — Jason C Smith
(74) *Attorney, Agent, or Firm* — Sandberg Phoenix & von Gontard, P.C.

(57) ABSTRACT

A zip line includes a substantially rigid track supported above a ground surface by a plurality of supports, a trolley which moves along the track, and a rider support suspended from the trolley. The track is comprised of a plurality of track segments connected together such that adjacent track segments have substantially no freedom of movement relative to each other, and such that adjacent track segments present a substantially smooth, continuous, and uninterrupted surface. The track includes a run and a flange extending upwardly from the run. The trolley comprises a frame having upper wheel mounts to which first and second upper wheels are rotatably mounted. The first upper wheels are oriented such that they engage an upper surface of the track run and the second upper wheels are oriented such that they will engage the track flange upon rotational movement of the trolley relative the track run.

42 Claims, 22 Drawing Sheets

(51) Int. Cl.

| | |
|---|---|
| ***B61B 3/00*** | (2006.01) |
| ***A63G 21/20*** | (2006.01) |
| ***B61B 12/00*** | (2006.01) |

(56) References Cited

U.S. PATENT DOCUMENTS

| | | | | |
|---|---|---|---|---|
| 5,038,900 | A * | 8/1991 | Durant | D01H 9/005 198/465.4 |
| 5,149,149 | A * | 9/1992 | Wu | F16B 7/0413 285/396 |
| 5,231,932 | A * | 8/1993 | Enderlein | B65G 19/025 104/162 |
| 5,653,172 | A * | 8/1997 | Roschier | B66B 9/187 104/118 |
| 5,711,553 | A * | 1/1998 | Bonser | F16L 37/0985 285/319 |
| 6,138,574 | A * | 10/2000 | Zaguroli, Jr. | E01B 25/24 104/106 |
| 6,360,669 | B1 * | 3/2002 | Albrich | B61B 3/00 104/173.1 |
| 6,745,891 | B2 * | 6/2004 | Walter | B61B 10/025 104/172.4 |
| 6,758,325 | B2 * | 7/2004 | Greeley | B61B 3/00 198/465.4 |
| 8,037,978 | B1 * | 10/2011 | Boren | H02K 49/04 104/281 |
| 8,863,668 | B2 * | 10/2014 | Quattlebaum | B61B 3/02 104/123 |
| 9,896,270 | B2 * | 2/2018 | Froiz Espino | B65G 9/00 |
| 2008/0229967 | A1 * | 9/2008 | Lins | A63G 21/22 104/173.1 |
| 2009/0293757 | A1 * | 12/2009 | Bischofberger | B61B 12/02 104/123 |
| 2010/0107919 | A1 * | 5/2010 | Perakis | A63G 21/22 104/112 |
| 2017/0120935 | A1 * | 5/2017 | Reese | A63G 9/12 |

FOREIGN PATENT DOCUMENTS

| | | | |
|---|---|---|---|
| FR | 2900834 | A1 | 11/2007 |
| WO | 98025678 | A1 | 6/1998 |

OTHER PUBLICATIONS

Husson International, The Play Equipment Catalogue, 2013.
Taylor-Made Play Equipment brochure, 2001.

* cited by examiner

ZIP LINE ASSEMBLY AND TROLLEY THEREFORE

CROSS-REFERENCE TO RELATED APPLICATIONS

This application claims priority to U.S. Pat. App. No. 62/247,580 which was filed on Oct. 28, 2015 and which is incorporated herein by reference.

STATEMENT REGARDING FEDERALLY SPONSORED RESEARCH OR DEVELOPMENT

Not Applicable.

BACKGROUND OF THE INVENTION

This application relates to play elements for playgrounds, and in particular, to zip lines for playgrounds.

Communities which install playgrounds often look for new and exciting ways to physically challenge the people that use playgrounds. Such people are typically young children. But, often, older children, such as teenagers, will use playgrounds. The typical playground equipment is often not size appropriate for teenagers or other taller children. It would thus be desirable to provide a playground element which would add fun and excitement to playgrounds, and which could also be used by teenagers and bigger children.

BRIEF SUMMARY

Briefly stated, a zip line is disclosed which comprises a substantially rigid track supported above a ground surface by a plurality of supports, a trolley adapted to move along the track, and a rider support suspended from the trolley. The track is comprised of a plurality of track segments connected together such that adjacent track segments have substantially no freedom of movement relative to each other, and such that a junction between adjacent track segments presents a substantially smooth, continuous, and uninterrupted surface. Each track segment comprises a run and a flange extending from an upper portion of the run. The trolley, as noted, is adapted to move along the track. The trolley comprises a frame having upper wheel mounts. Each upper wheel mount includes a first surface to which at least one first upper wheel is rotatably mounted and a second surface to which at least one second upper wheel is rotatably mounted. The first surface is oriented such that the at least one first upper wheel engages an upper surface of the track run and the second surface is oriented such that the at least one second upper wheel will engage the track flange upon rotational movement of the trolley relative to the track run.

In accordance with one aspect of the trolley, each upper wheel mount comprises an upper wheel bracket, wherein the first surface is defined by a first upper wheel plate and second surface is defined by a second upper wheel plate. The first upper wheel plates can each define an angle of between about 0° and about 60° relative to a vertical axis of the trolley. The second upper wheel plates can be substantially perpendicular to a vertical axis of the trolley.

In accordance with an aspect of the trolley, the first upper wheels have generally flat peripheral surfaces which define a cylinder, and the first upper wheel plate defines an angle of between about 30° and about 60° relative to a vertical axis of the trolley.

In accordance with an aspect of the trolley, the first upper wheels are generally parallel to the vertical axis of the trolley. In this instance, the first upper wheels have a peripheral surface which is generally angled relative to the axis of the trolley. The peripheral surface of the first upper wheels, for example, can define an arch which corresponds generally to a curvature of the track run, and the upper wheel mounts can be defined by a block.

In accordance with another aspect of the trolley, the trolley can further include at least one lower wheel mount. The lower wheel mount can comprise a lower wheel surface having at least one lower wheel rotatably mounted thereto. The lower wheel has a circumferential surface facing the track run and being slightly spaced from the track run when the first upper wheels are in engagement with the track run.

The at least one lower wheel mount can include right and left lower brackets, and the lower wheel surface can comprise a lower wheel plate on each of the left and right brackets. Each lower wheel has a circumferential surface facing the track run and which is slightly spaced from the track run when the first upper wheels are in engagement with the track run.

The lower wheel mount can comprise a block.

In accordance with an aspect of the trolley, the lower wheel mount surfaces define an angle of between about 30° and about 60° relative to a vertical axis of the trolley.

In accordance with an aspect of the trolley, the rider support is suspended from the lower wheel mount.

In accordance with an aspect of the trolley, the trolley can include a plate extending between a pair of downwardly extending flanges. In this instance, the rider support is suspended from this plate, and the plate extends generally perpendicular to the direction of travel of the trolley.

In a variation, the rider support is suspended from a bar suspended from the trolley. This bar is generally perpendicular to the axis of the trolley and has a length greater than a width of the trolley. In one variation, the trolley lower wheel mount can include a pair of flanges extending downwardly from the bracket, and the bar can extend through the flanges. In another variation, the trolley can include a bar connector pivotally connected to the trolley lower wheel mount. In this variation, the lower wheel mount comprises a downwardly extending flange, and the connector comprises a body which receives the bar and at least one flange extending up from the body, whereby the connector flange and the mount flange are pivotally connected together. In this variation, the bar can pivot relative to the trolley in a plane generally perpendicular to the direction of travel of the trolley.

In accordance with an aspect of the track, the track segment runs are hollow at least at opposite ends of each run, and the connector comprises a body having an outer surface sized and shaped correspondingly to the hollow ends of the track runs such that the connector can be snuggly received in the hollow ends of adjacent track runs. The connector further includes a flange extending about the body and having a width approximately equal to the thickness of the hollow ends of the track run, such that, when the track is assembled, end surfaces of the track runs substantially abut opposite sides of the connector flange.

In accordance with an aspect of the track, the track supports comprise a main support member comprising a generally vertical section extending upwardly from the ground and a generally horizontal section connected to the generally vertical section. The track is suspended from the generally vertical section such that the track is below the generally vertical section of the support. The generally vertical and horizontal sections of the main support can be connected by a curved section.

In accordance with an aspect of the track, the supports can further comprise a second generally vertical leg spaced from the generally vertical section of the main support, with the second generally vertical leg extending upwardly from the ground to engage the main support.

In accordance with an aspect of the track, the support includes a track mounting bracket and at least selective track segments include a track mounting portion. The mounting bracket and track segment mounting portion have holes positioned to be aligned, whereby the track segments are connected to the bracket by means of fasteners.

In accordance with an aspect of the track, the track can include a stop at at least one end thereof.

In accordance with an aspect of the track, the track segments are formed to be straight, curving left, curving right, curving up or curving down.

BRIEF DESCRIPTION OF THE SEVERAL VIEWS OF THE DRAWINGS

Corresponding reference numerals will be used throughout the several figures of the drawings.

DETAILED DESCRIPTION

Figure 1:
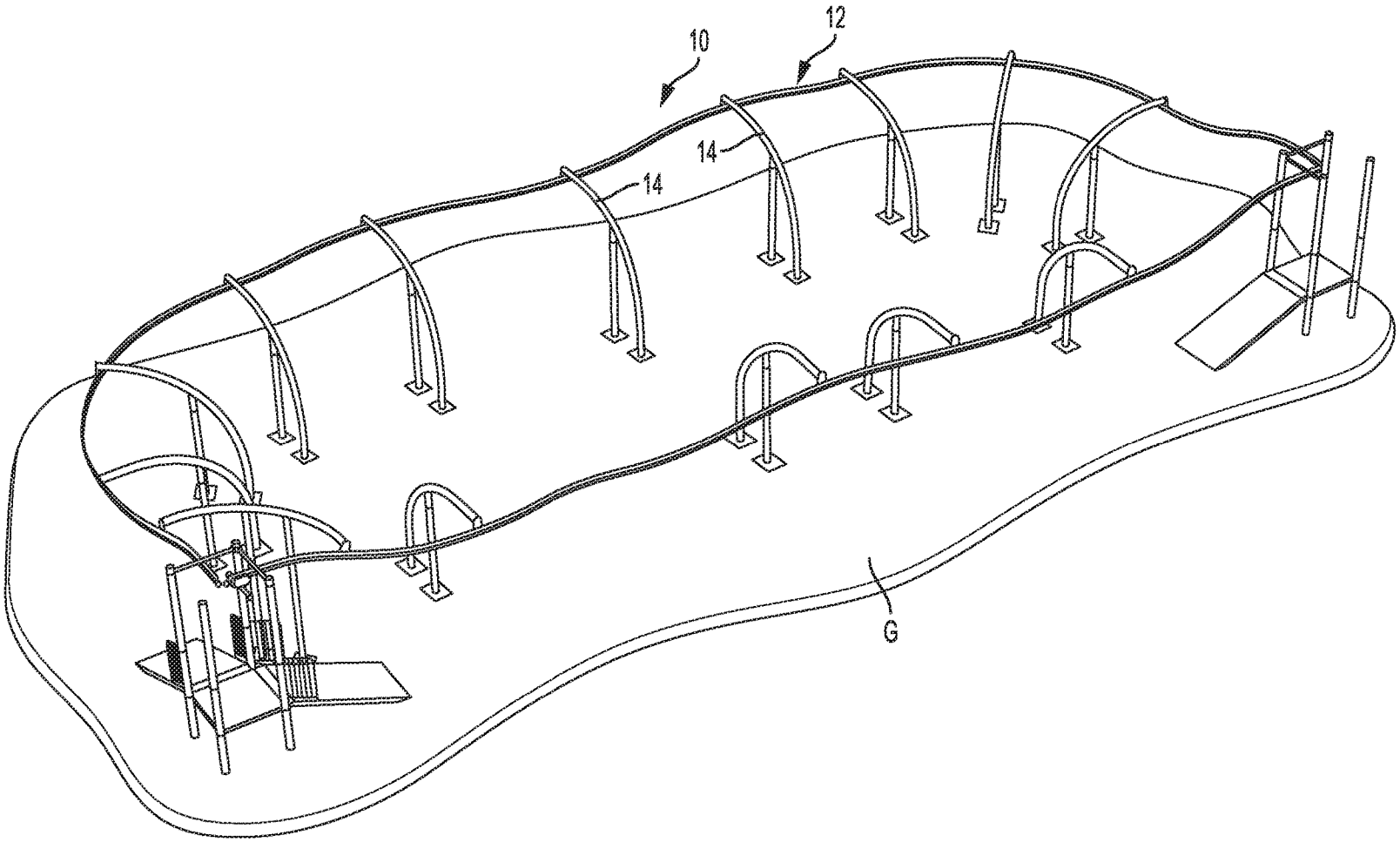
FIG. 1 is a perspective view of an installed zip line assembly.

The following detailed description illustrates the claimed invention by way of example and not by way of limitation. This description will clearly enable one skilled in the art to make and use the claimed invention, and describes several embodiments, adaptations, variations, alternatives and uses of the claimed invention, including what we presently believe to be the best mode of carrying out the invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

Figure 2:
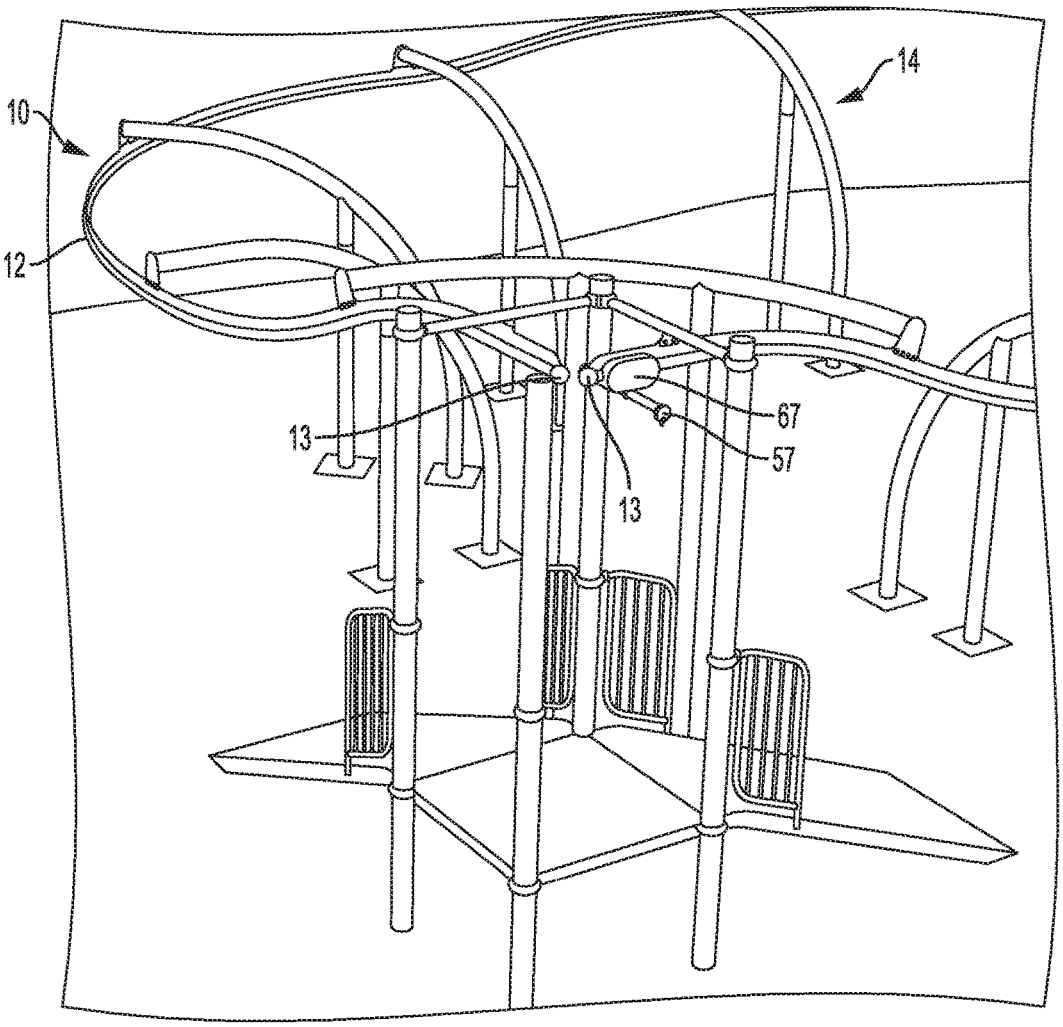
FIG. 2 is an enlarged view of an end of the zip line assembly, showing the trolley for the zip line.

A zip line assembly 10 is shown generally in FIG. 1 and enlarged in FIG. 2. The zip line assembly 10 comprises a rigid track 12 supported above the ground G by a plurality of supports 14. A trolley 16 slides along the track 12 to transport users along the track 12. The track 12 can be provided with stops 13 at ends of the track 12 to prevent the trolley 16 from coming off the track 12.

Figure 3:
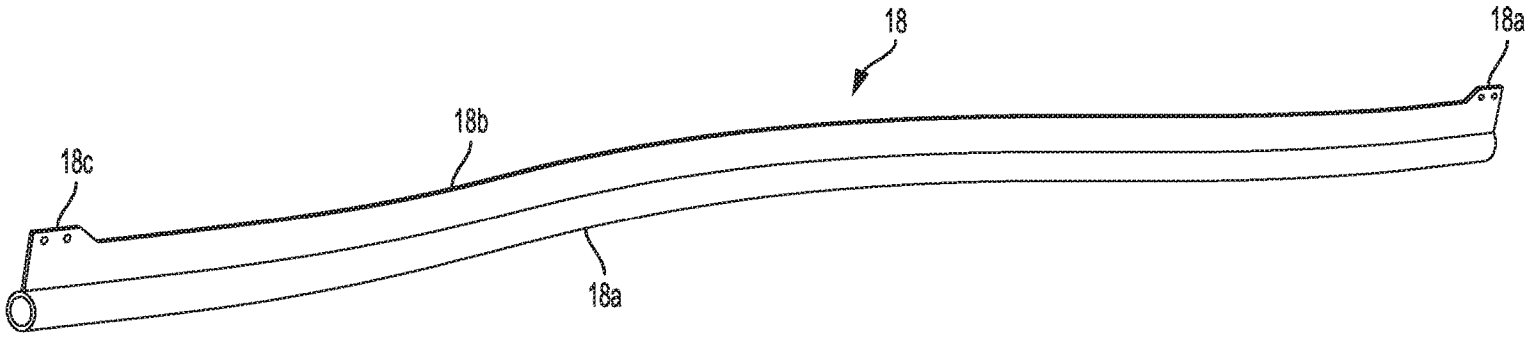
FIG. 3 is a perspective view of a section of zip line track.

The track 12 is made from a plurality of track segments 18 (FIGS. 3-4) which are connected together by means of connectors 20. Each track segment 18 comprises a run 18*a* with a fin or flange 18*b* extending upwardly from the run 18*a* and which extends the length of the run 18*a*. Mounting plates 18*c* (FIG. 5) extend upwardly from the opposite ends of the flange 18*b*. The mounting plates 18*c* have bolt holes to facilitate connection of the track segment to the supports 14, as described below. The run 18*a* is shown to be in the form of a cylindrical tube. However, the tube of the run can be formed in any desired shape. Thus, the run 18*a* can, for example, be oval or polygonal. Alternatively, the run could define a segment of a circle, and could, for example, in cross-section define an arc of 180°, 270°, or any other desired arc. The track segments 18 can be formed in any number of ways. The track segments 18 are preferably metal, and can be formed, for example, from steel. The track run can be formed from tube stock, such as by bending. The flange 18*b* is preferably made from the same material as the run. It can be formed separately from the run 18*a* and then fixed to the run, for example, by welding. Alternatively, the run and flange can be formed integrally, for example in an extrusion or pultrusion process. As another alternative, the track segments can be formed from appropriately engineered materials or any other material which will withstand the environment in which the track segments will be placed and the use to which they will be subjected.

Track segments can be provided that are straight, which curve up, which curve down, which curve to the left or right, and which can define either a vertical or a horizontal wave.

Further, the vertical waves can be upwardly or downwardly extending waves; and the horizontal waves can extend to the right or left. The various track segment shapes allows for a designer to produce a zip line assembly of any desired shape and size. For example, as seen in FIG. 1, the zip line assembly includes one section that undulates along a generally straight line between two end points and a second section that generally defines a U-shape and extends between the same two end points. The overall zip line assembly 10 can thus enclose a defined area, as seen in FIG. 1. As can be appreciated, although not shown, stand-alone playground elements (slides, swings, climbers, etc.) or playground assemblies could be positioned within this area, such that the zip line assembly surrounds the playground. The zip line assembly of FIG. 1 as noted includes two separate zip lines, each of which includes stops 13 (shown in FIGS. 6A-B) at the opposite ends of the track for each zip line to prevent the trolley from coming off the track. However, the track can be formed as a continuous loop. In such a case, there would be no "end" to the track, and thus a stop 13 would not be needed.

Figure 4:
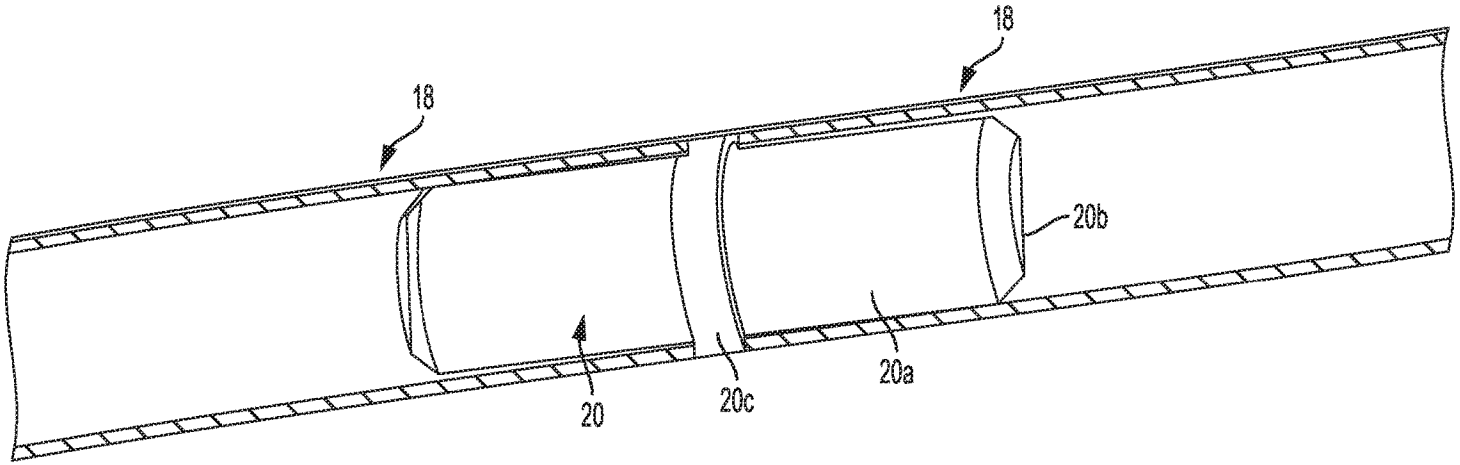
FIG. 4 is a cross-sectional view showing the connection of two pieces of zip line track connected together.

Turning to FIG. 4, the track segments 18 are hollow, at least at their ends to receive a connector 20 which connects adjacent track segments together. The connector can be made of a metal, plastic, rubber, or any other desired material. The connector 20 has an elongate body 20*a* with beveled ends 20*b* and a circumferential or peripheral flange 20*c* extending from the approximate center of the body 20*a*. The connector body 20*a* is shaped complementarily to the internal shape of the track segment 18. Preferably, the hollow end of the track segment and the connector body are both circular in cross-section. The connector body 20*a* is sized to fit snugly within the end of the track segment, such that there is substantially no play between the track segment and the connector. The connector 20 thus rigidly connects track segments 18 together, and adjacent track sections have substantially no freedom of movement relative to each other. The flange 20*c* has a height substantially equal to the thickness of the track segment wall, as seen in FIG. 4, and a peripheral shape corresponding to the peripheral shape of the track run. The flange 20*c* thus serves as a stop when inserting the connector into one track segment, and prevents the connector from being pushed further into the first track segment when a second segment is forced onto the opposite end of the connector. Because the flange 20*c* has a height substantially equal to the thickness of the track segment wall and a shape corresponding to the peripheral shape of the track run, the track 12 will present a substantially smooth, continuous and uninterrupted surface to the trolley. Adjacent track sections can be connected by any other connection means which, like the connector 20, will provide a rigid connection between adjacent track sections and in which the connection presents a substantially smooth, continuous and uninterrupted surface to the trolley.

Figure 5:
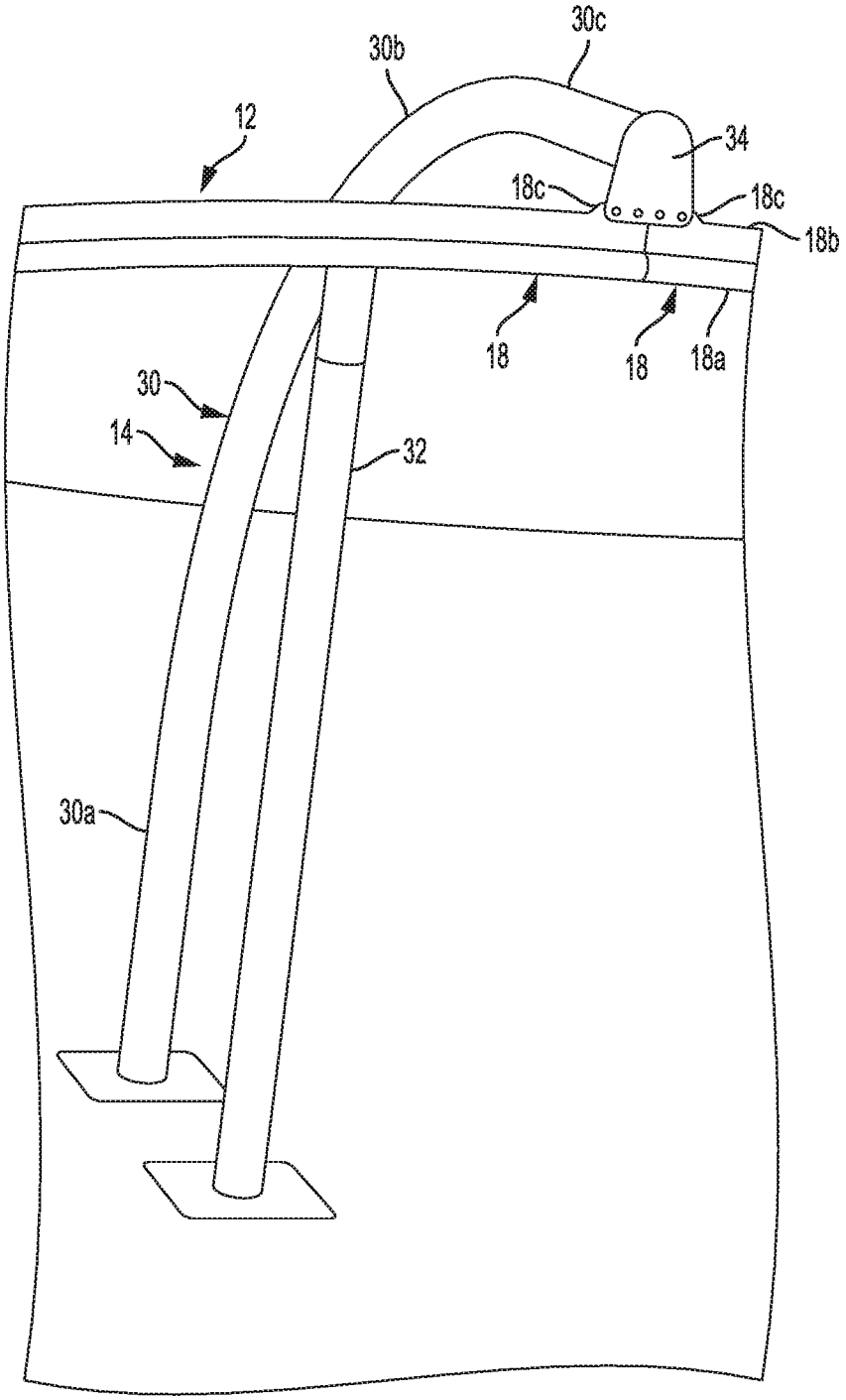
FIG. 5 is an enlarged view of a section of the zip line assembly, showing a zip line track support and the connection of a zip line track segment to the support.

As best seen in FIG. 5, the track supports 14 comprise a main support member 30 from which the track 12 is suspended. The support member 30 has a first generally vertical portion 30*a* which extends up from the ground G. This support then curves as at 30*b* to end in a generally horizontally extending section 30*c*. The track supports 14 also include a vertical support member 32 which extends upwardly from the ground and is connected to the main support 30 along the curved section 30*b* of the main support 30. A mounting bracket 34 is fixed to the end of the main support 30. The mounting bracket is shown in FIG. 5 to be more or less in the shape of in inverted U (i.e., generally "∩"-shaped). The bracket 34 has a lower edge having a length substantially equal to the combined length of the mounting plates 18*c* of two connected track segments 18. The bracket 34 includes a plurality of bolt holes which are positioned to be aligned with the bolt holes of the track segment mounting plates 18*c*. Bolts or other fasteners are then used to secure the segments 18 to the mounting bracket 34, such that the track 12 is suspended from (and is thus below) the end of the main supports 30. In FIGS. 1 and 2, the track supports 14 are all shown to be within the area defined by the track 12. However, the supports 14 could all be outside the area defined by the track 12. This would provide a larger area for additional playground equipment within the area defined by the track 12. Alternatively, some of the supports 14 can be on one side of the track 12 and other supports 14 can be on an opposite side of the track 12.

Figure 6A:
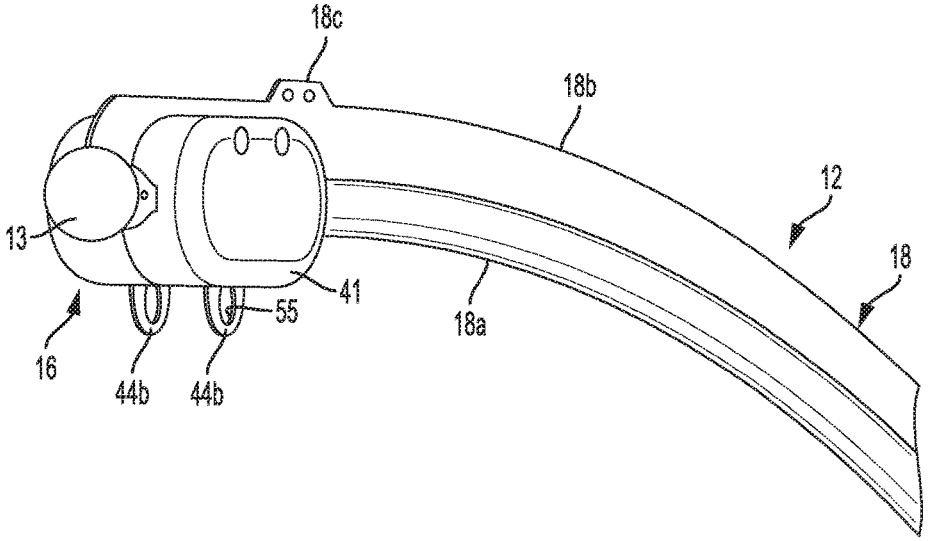
FIGS. 6A and 6B are perspective views showing the trolley on a track segment.
Figure 6B:
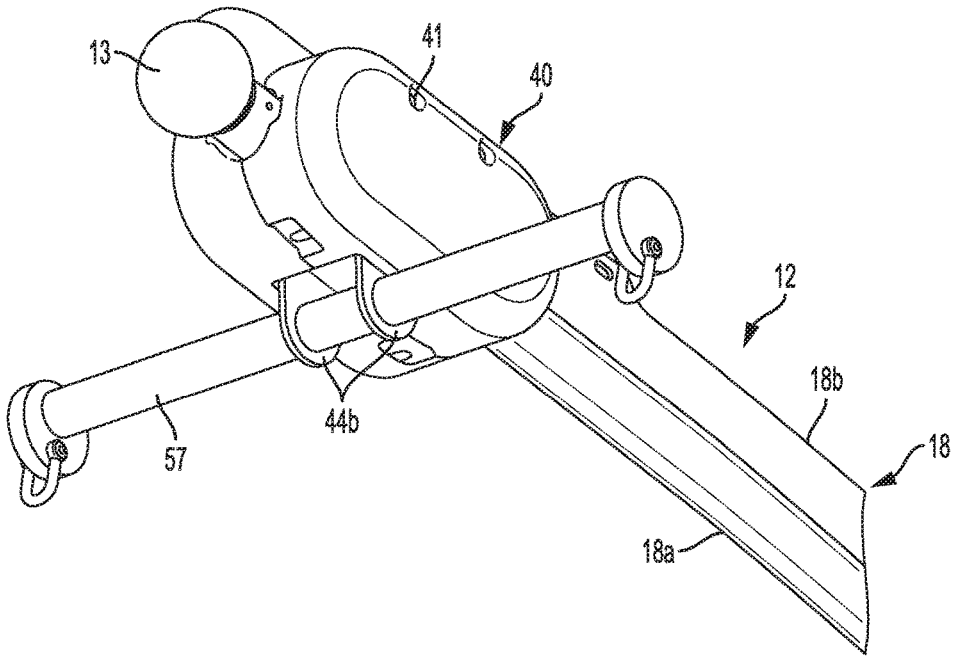

The trolley 16 is shown enlarged in FIGS. 6A and 6B, and is shown in more detail in FIGS. 7-12. The trolley 16 comprises a frame 40 which is substantially enclosed by a housing 41, as can be seen in FIGS. 6A-B. The housing can be formed from a plastic, rubber, or any other desired material. If the housing is formed from a plastic or rubber, it can be formed by a molding process. The trolley frame 40 comprises two end plates 42 spaced apart by a lower wheel mount 43 and an upper wheel mount 47. (FIG. 12) In the embodiment of FIGS. 6A-12, the lower wheel mount 43 is comprised of two lower wheel brackets 44 and the upper wheel mount 47 is comprised of two upper wheel brackets 46. The end plates 42 have inner and outer edges 42*a*, 42*b*, respectively, and end edges 42*c*. The inner edges 42*a* of the end plates are shaped complimentarily to the shape of the track segment run portion 18*a* so as to define a gap 48 (FIG. 12) of substantially constant size between the track run 18*a* and the plate inner edge 42*a*. The run 18*a* is shown to be cylindrical, and thus the end plate inner surface defines an arc. The end plates 42 do not fully surround the track run 18*a*, but extend more than half-way around the run. Thus, for example, the inner edge 42*a* defines an arc of between about 250° and 300°. In the illustrative trolley of FIGS. 7-12, the inner edge of the end plate defines an arc of about 270°. The outer edge 42*b* of the end plate is shown to be concentric with the inner surface 42*a*. However the outer edge 42*b* could have any desired shape.

The lower wheel brackets 44 each have a wheel plate 44*a* which extends between the two end plates 42. The wheel plates 44*a* are angled relative to a vertical axis A of the frame 40, and can define an angle of between about 30° and 60°, and preferably about 45°, relative to the vertical axis A. A lower wheel 50 is rotatably mounted to each wheel plate 44*a*. The lower wheels 50 are sized, as seen, to extend beyond the upper edge of the wheel plate which is proximate the track run 18*a*. The trolley 16 is shown with a single lower wheel 50 mounted to the wheel plate 44*a* approximately midway between the ends of the wheel plate 44*a*. The lower wheels 50 will not be weight bearing wheels, and thus, a single wheel on each lower wheel plate 44*b* is sufficient. However, two or more lower wheels could be provided on the lower wheel plate, if desired.

Figure 7:
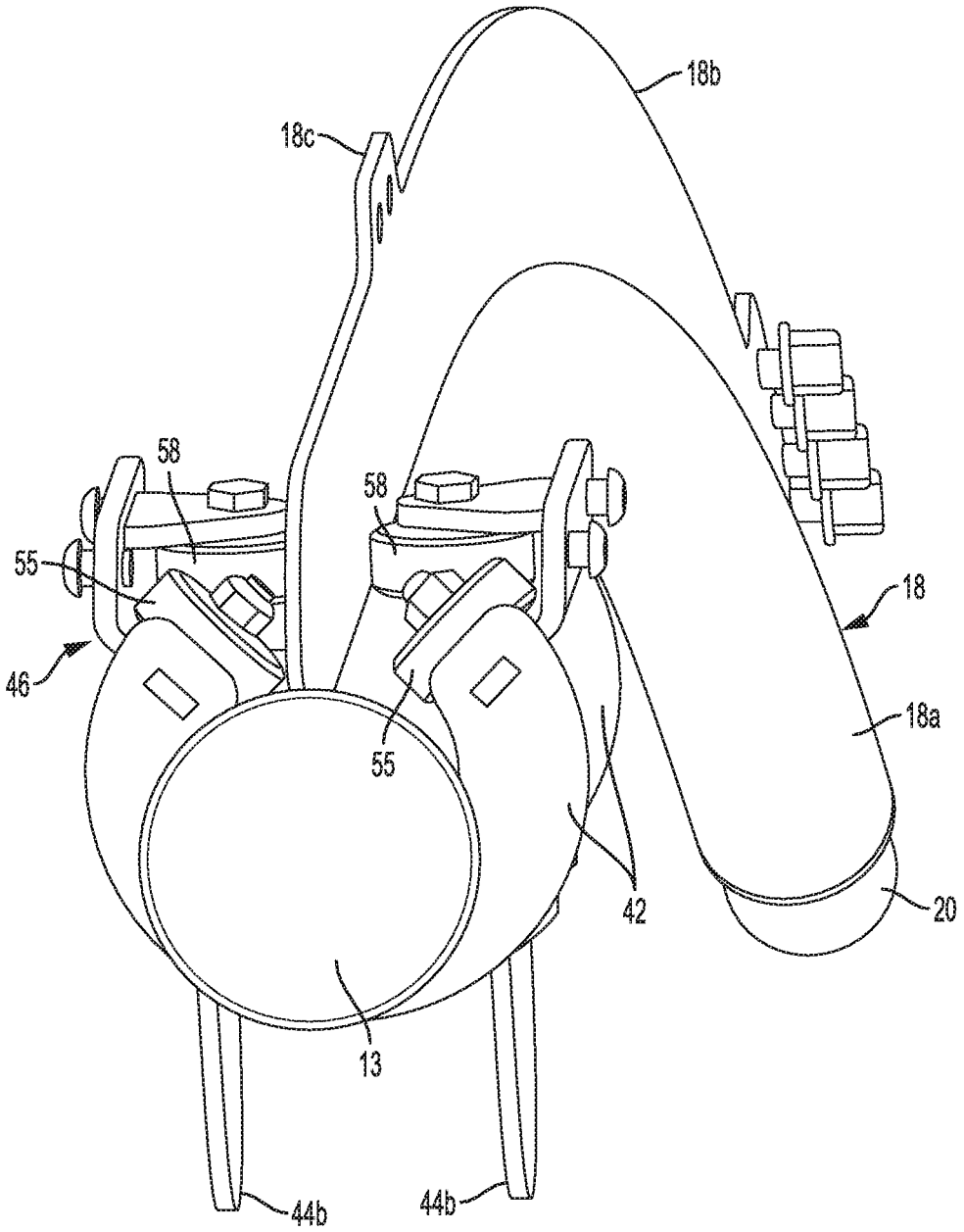
FIG. 7 is an enlarged front perspective view of the trolley on the track segment, but with a trolley housing removed to show the trolley frame.
Figure 8:
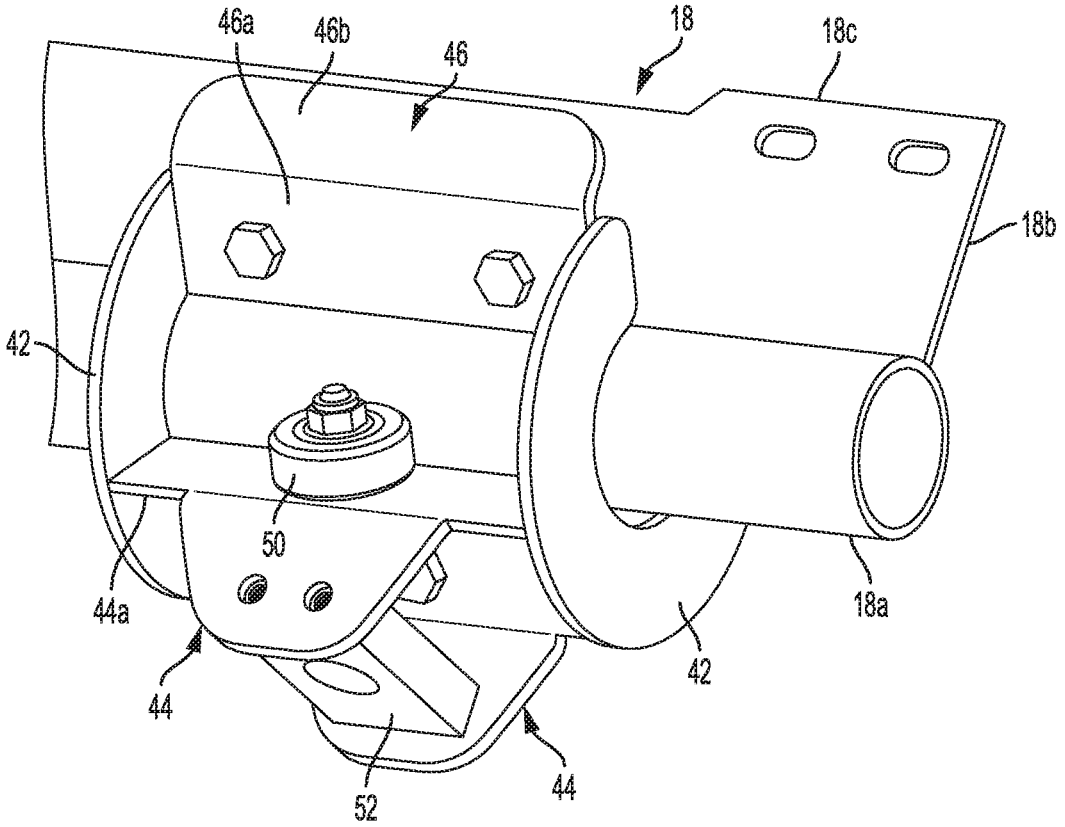
FIG. 8 is a bottom perspective view of the trolley frame on a track segment.
Figure 9:
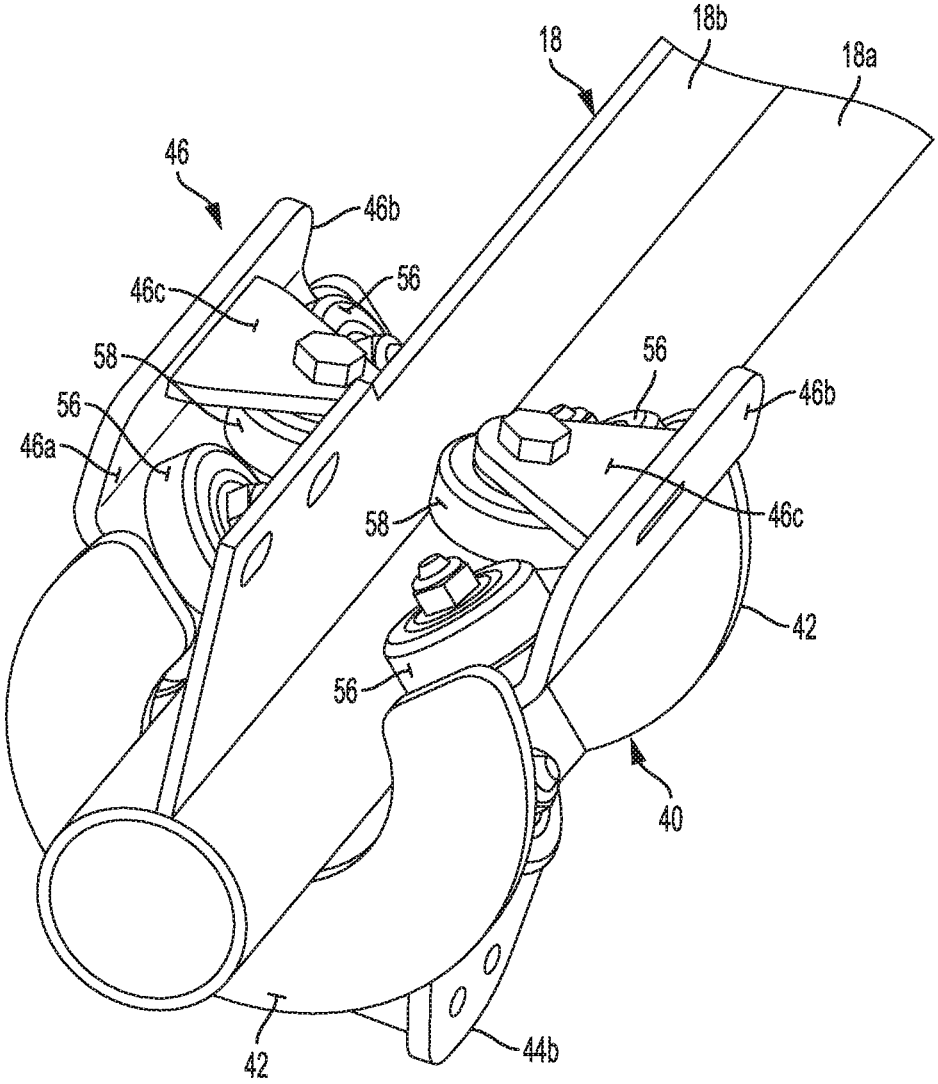
FIG. 9 is a top perspective view of the trolley frame on a track segment.
Figure 10:
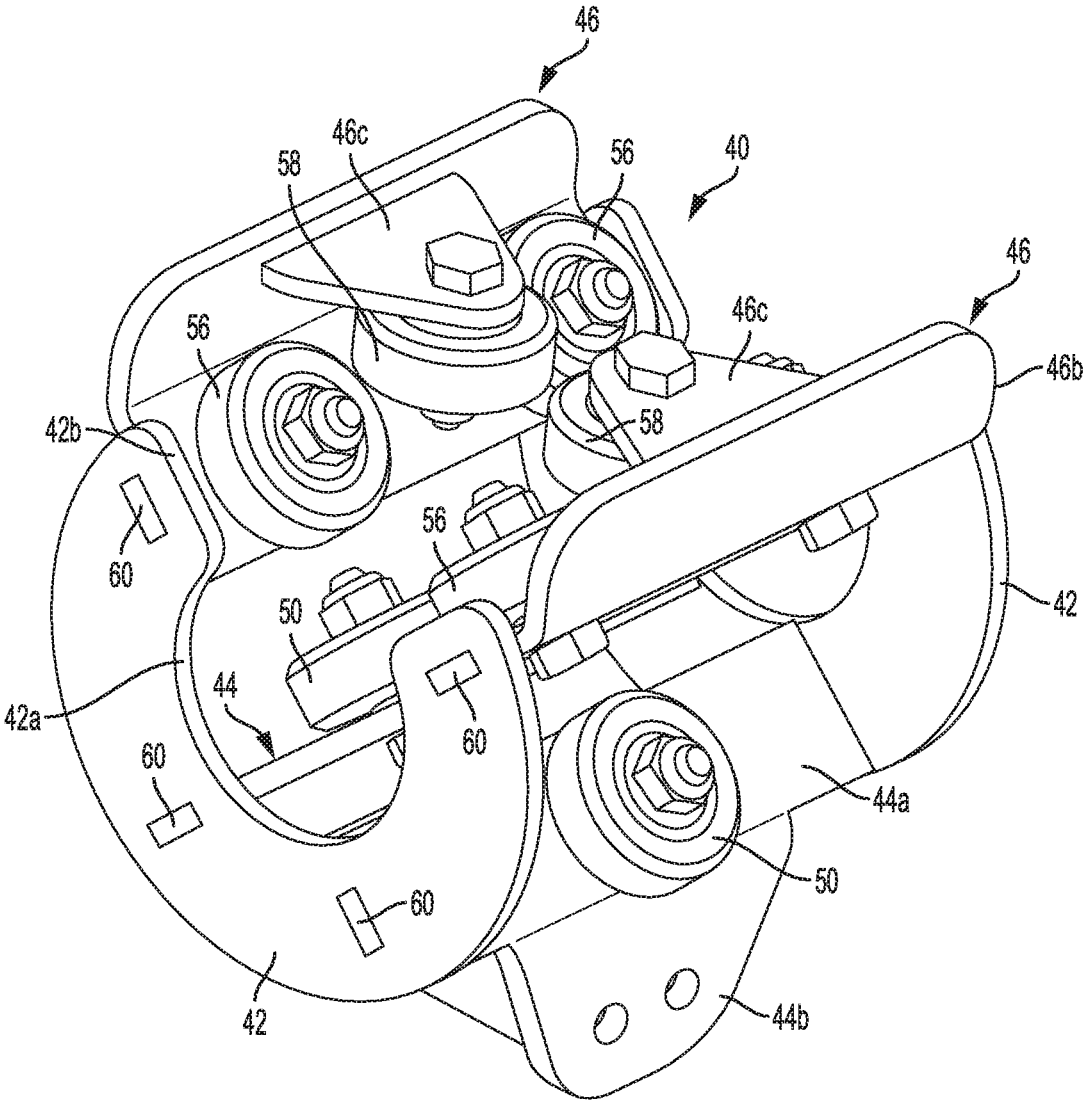
FIG. 10 is a side perspective view of the trolley frame.
Figure 11:
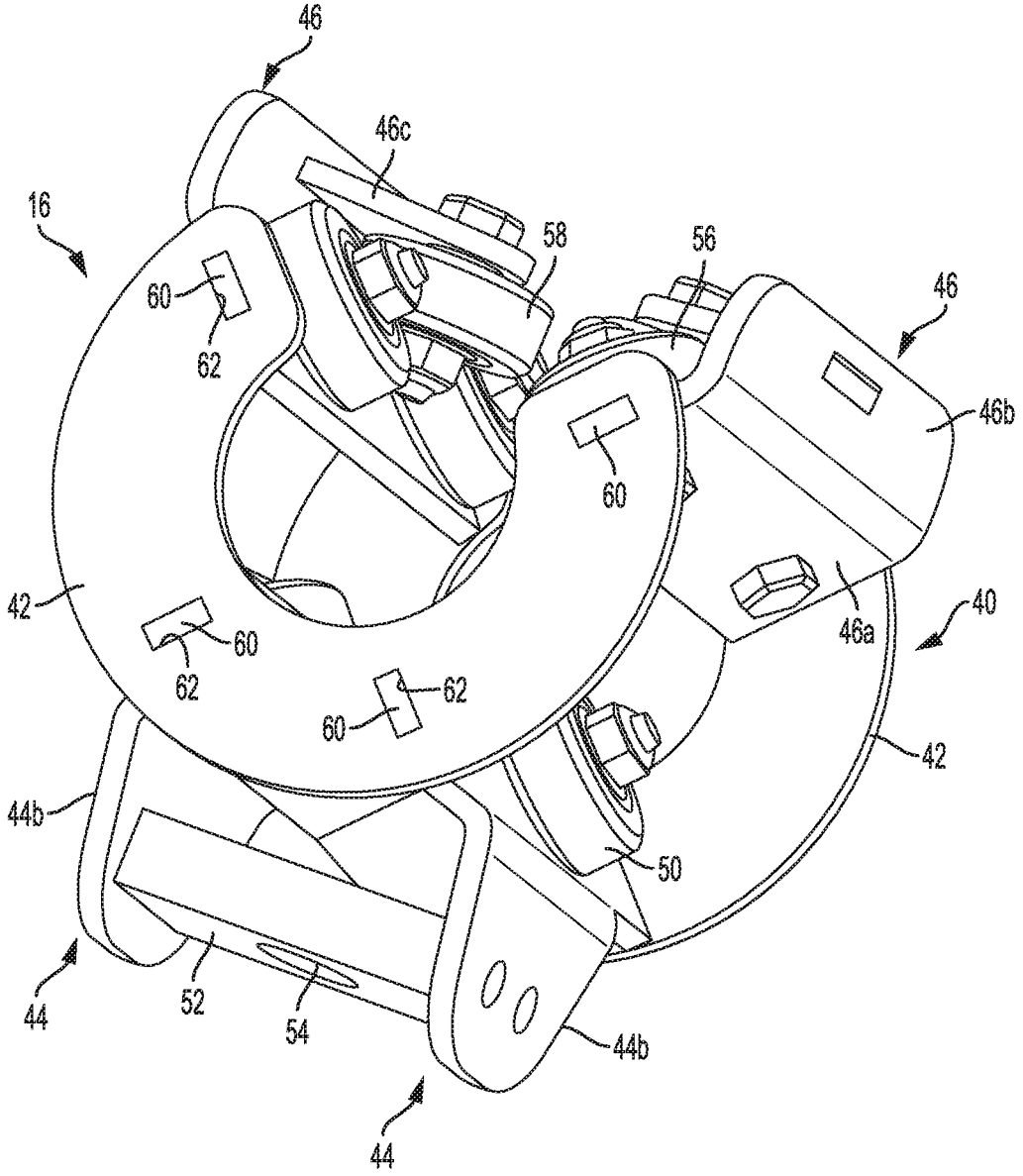
FIG. 11 is front perspective view of the trolley frame.
Figure 15:
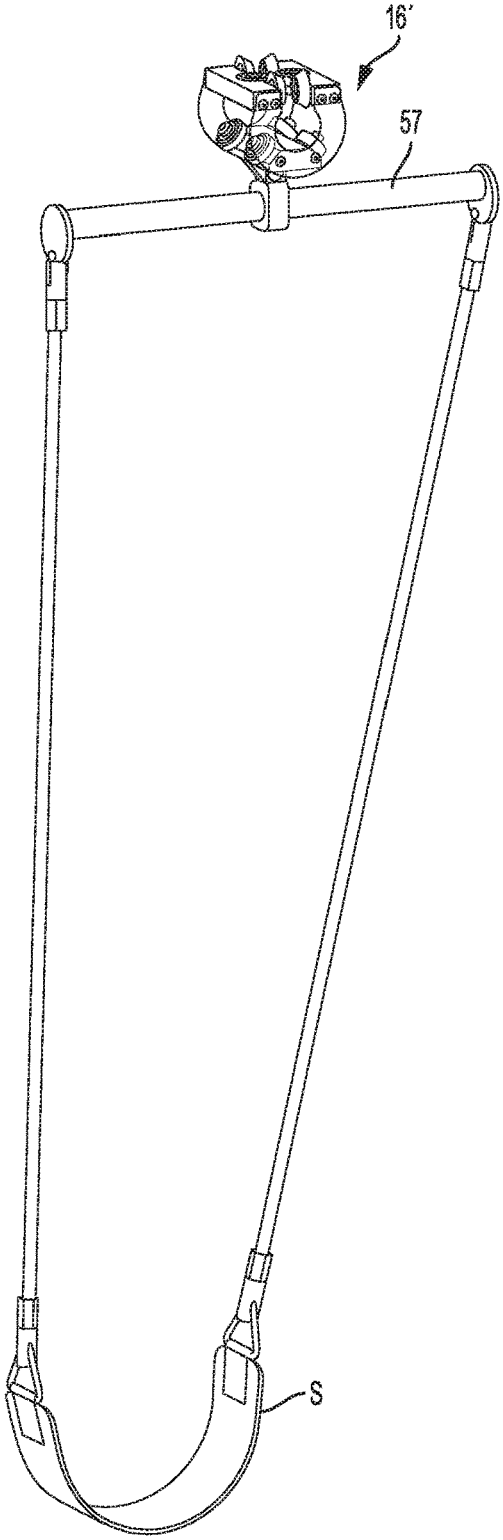
FIG. 15 is a perspective view of the trolley of FIG. 14 showing a seat suspended from the rider support bar.
Figure 16:
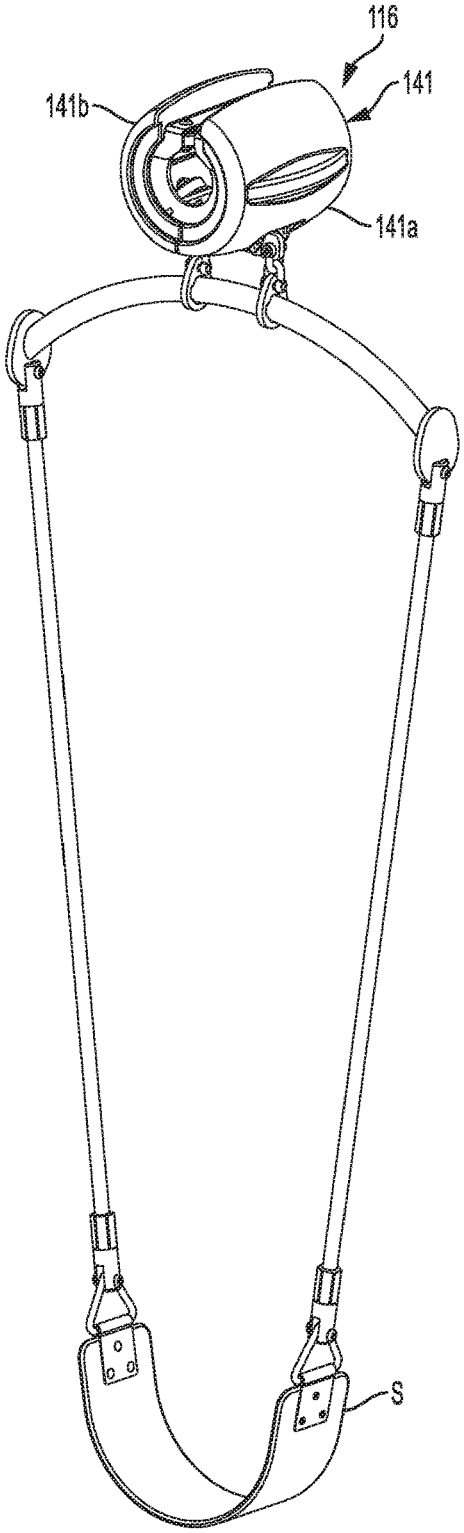
FIG. 16 is a perspective view of another embodiment of the trolley and showing a seat suspended from the rider support bar.
Figure 17:
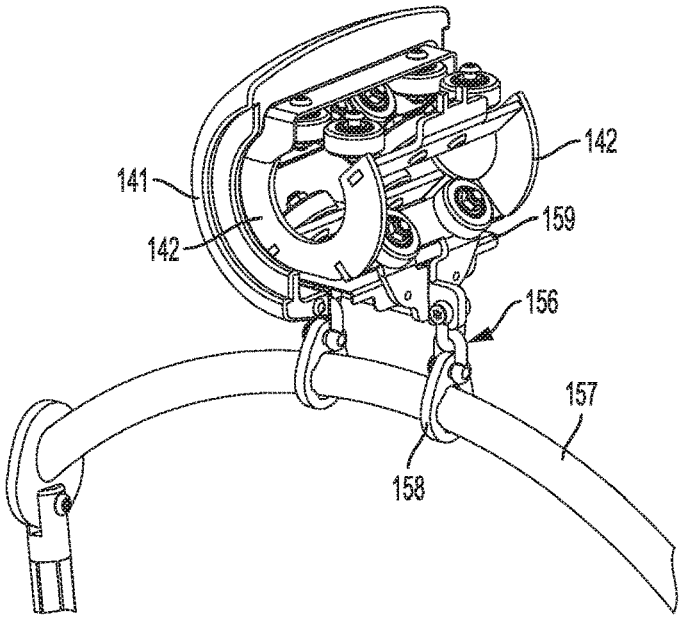
FIG. 17 is a perspective view of the trolley of FIG. 16, with a portion of the housing removed to show the trolley frame.

A rider support S, such as a flexible seat as shown in FIG. 15, can be suspended from the trolley in any desired manner. In the trolley shown in FIGS. 6A-12, a flange 44*b* extends downwardly from each wheel plate 44*a*. As seen, the flanges 44*b* are generally vertical (i.e., generally parallel to the axis A). In FIGS. 8-12, the trolley includes a bar 52 extending between the two flanges 44*b*. The bar 52 has a centrally positioned hole 54 to which a rider support (not shown) can be connected. Such a rider support can be a rope or bar to which the rider holds on to, a seat (as shown in FIG. 15), a harness, etc. In FIGS. 6A, 6B, and 7 the flanges 44*b* include aligned holes 55 through which an elongate tubular bar 57 extends. As seen, the bar 57 extends beyond the sides of the trolley. A harness, seat S, etc., could then be suspended from this elongate tubular bar by means of a either a flexible cord, a chain, or a rigid rod. The type of rider support used and the manner in which it is mounted to the trolley will depend on the type of zip line installation.

Figure 12:
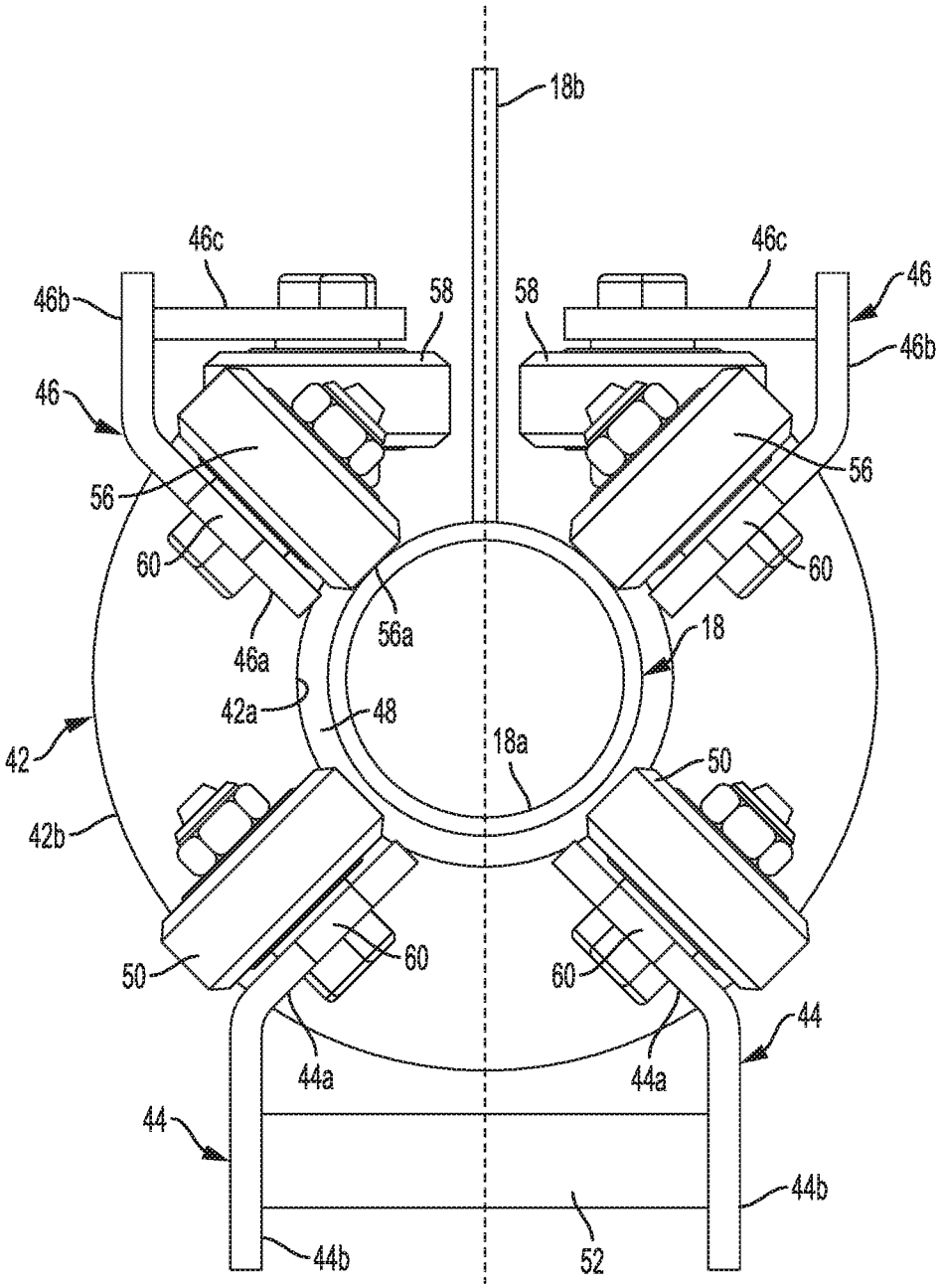
FIG. 12 is a front elevational view of the trolley frame on a track segment with an end plate removed from the trolley frame to better show the wheels of the trolley.

The upper wheel brackets 46 similarly extend between the end plates 42. The upper wheel brackets 46 each have a wheel plate 46*a* which extends between the two end plates 42. The wheel plates 46*a* are angled relative to a vertical axis A of the frame 40, and can define an angle of between about 30° and 60°, and preferably about 45°, relative to the vertical axis A. First upper wheels 56 are rotatably mounted to each upper wheel plate 46*a*, and include a generally flat peripheral surface 56*a* which defines a cylinder. The first upper wheels 56 are sized, as seen, to extend beyond the lower edge of the wheel plate which is proximate the track run 18*a*. As seen in FIG. 12, the first upper wheels ride on the track run 18*a*. The upper wheels thus support the weight of the rider. Therefore, the trolley preferably includes more than one first upper wheel 56. Two first upper wheels 56 are shown (see FIG. 11), but more could be used if desired. A wall 46*b* extends upwardly from the wheel plate 46*a* such that the wall 46*b* is generally parallel to the vertical axis A (and thus to the track flange 18*b*). A second wheel plate 46*c* extends inwardly from the wall 46*b* toward the track flange 18*b*. As shown, the second wheel plate 46*c* is generally perpendicular to the axis A and the track flange 18*b*. A second upper wheel 58 is rotatably mounted to the second wheel plate 46*c*. The second wheels 58 are sized to extend beyond the inner end of the second wheel plate 46*c*, such that, if the trolley rotates about the track run 18*a*, the second upper wheels will engage or ride on the track flange 18*b* to thereby prevent more than a determined amount of rotation of the trolley about the track 18. As seen, this second wheel plate 46*c* is generally triangular in shape, and has a base edge substantially shorter than the length of the wall 46*b*. Thus, the second wheel plate has only one second upper wheel 58 rotatably mounted thereon. As can be appreciated, the second wheel plate 46*c* can be extended such that the trolley includes two or more second wheels 58. As seen, the upper wheel bracket 46 is shaped such that the second upper wheel 58 is normally in a plane that is generally perpendicular to the axis A and the track flange 18*b*. However, the upper wheel bracket could be shaped such that the plane of the wheel is generally perpendicular to the track flange 18*b* when the trolley is rotated such that a second upper wheel rides on the flange. In this instance, with the trolley shown as in FIG. 12, for example, the second wheel plate 46*c* would be angled slightly upwardly. Other desired angles for the second upper wheel 58 can be used as well.

The wheel brackets 44, 46 can be mounted between the end plates 42 in any desired manner. For example, the wheel plates can be provided with tongues 60 (FIG. 11) at the ends of the plates 44*a*,46*a* which extend into or through correspondingly shaped openings 62 in the end plates. The tongues 60 can, for example, be welded into the openings. Additionally, weldments can be formed between the edges of the wheel plates and the end plates.

Figure 13:
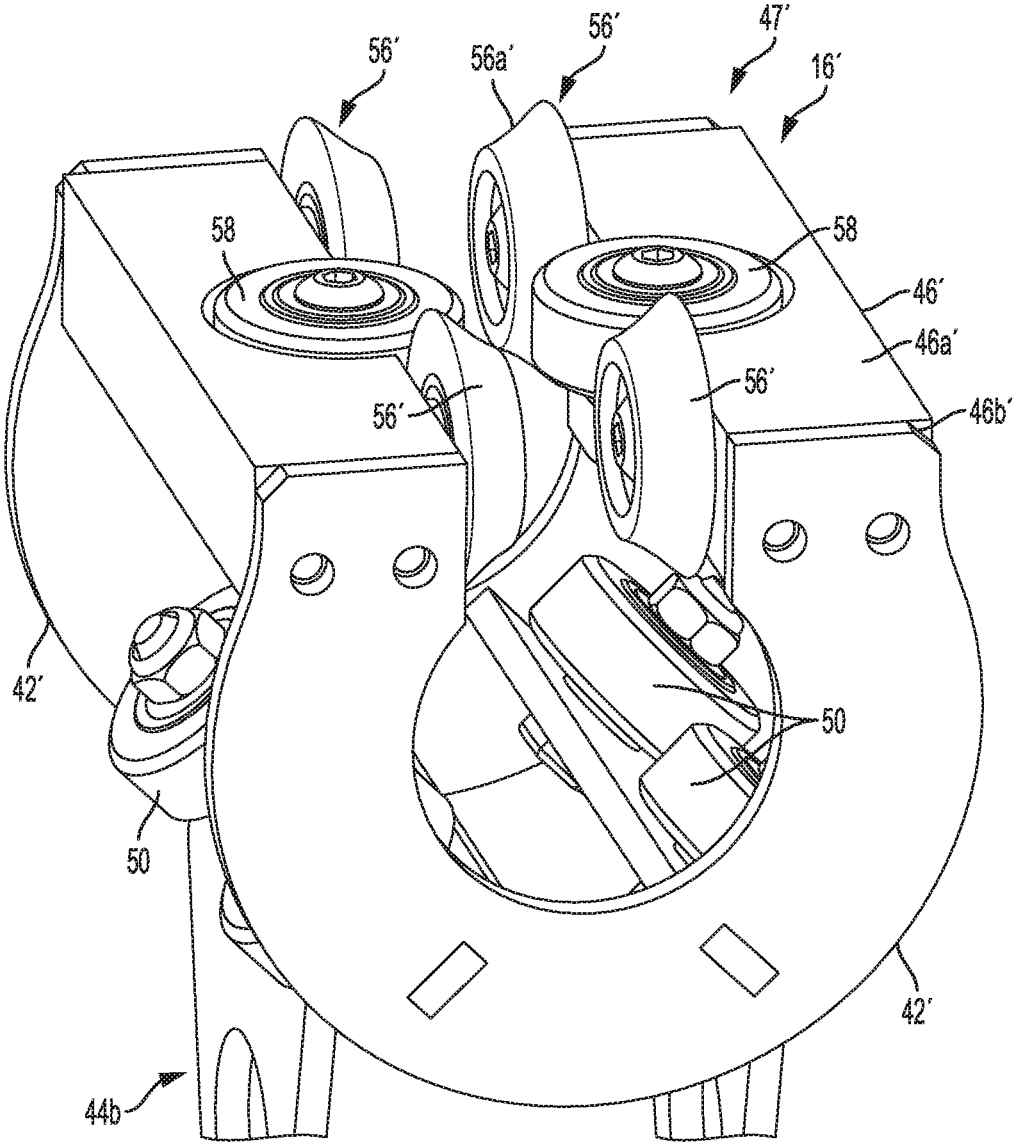
FIG. 13 is an end perspective view of an alternative embodiment of the trolley.
Figure 14:
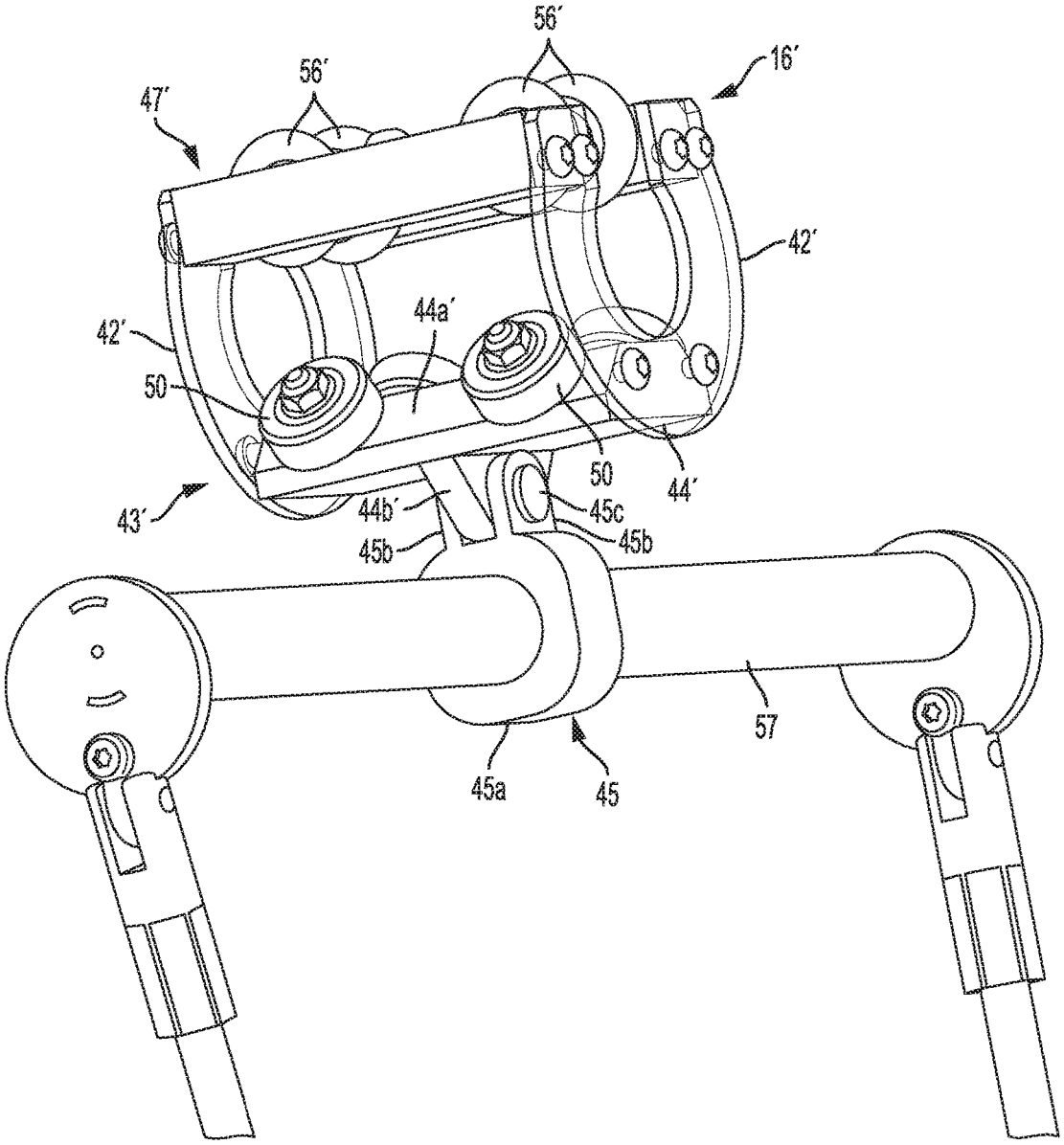
FIG. 14 is a side perspective view of the trolley of FIG. 13, but with a pivoting connection of a rider support bar to the trolley frame.

An alternate trolley embodiment is shown in FIGS. 13 and 14. The trolley 16' includes end plates 42' which are generally in the shape of a horseshoe. That is, the end plates include a track run surrounding section which defines an arc of approximately 270° and an end section which extends upwardly from the ends of the arced track run surrounding section. In the version of FIG. 13, the lower wheel mount comprises a pair of lower wheel brackets which are substantially identical to the lower wheel bracket 44*b* of FIGS. 6A-7, which were described above, and will not be described herein. In the version shown in FIG. 14, the lower wheel mount 43' is a single member in the form of a block 44' which spans the distance between the end plates. The block 44' can be formed, for example, from bar stock or by an extrusion or pultrusion process. The lower wheels 50 are rotatably secured to surfaces 44*a*' of the bracket which provide the desired angle to the lower wheel 50. To provide the desired angle, the surface 44*a*' can define an angle of between about 30° and about 60° relative to the axis A of the trolley. This gives the block generally the appearance of a trapezoid with a small side wall. As seen, two lower wheels 50 are mounted on each surface 44*a*' of the lower wheel bracket 44'. To connect the rider support S to the trolley, the lower wheel bracket 44' includes a flange 44*b*' which extends generally parallel to the end plates. A rider support connector 45 has a body 45*a* which receives the bar 57 and a pair of flanges 45*b* which sandwich the trolley flange 44*b*'. A pin (or other fastener) 45*c* extends through the connector flanges 45*b* and the trolley flange 44*b*' to pivotally connect the bar 57 to the trolley. With this connection, the rider support S can pivot relative to the trolley about an axis that is generally parallel to the direction of the track. Thus, a rider can swing from left to right relative to the track 12. (pivot connection of bar 57 to trolley frame).

The upper wheel mount 47' for the trolley 16' is formed from a pair of generally rectangular blocks, each having an upper surface 46*a*' which is generally perpendicular to the axis A of the trolley and an inner surface 46*b*' which is generally parallel to the axis A of the trolley. First upper wheels 56' are rotatably mounted to the inner surface 46*b*' of the upper wheel bracket 46'. As can be appreciated, the first upper wheels 56' will be generally parallel to the track flange 18*b*, and will bear straight down on the track run 18. To improve the contact of the first upper wheel 56' with the track run, the peripheral surface 56*a*' of the first upper wheel 56' approximates the curvature or shape of the run 18*a*. The track run 18*a* is shown to be generally circular in cross-section. Hence, the peripheral surface 56*a*' of the first upper wheel 56' defines or approximates an arc which generally corresponds to the curvature of the track run 18*a*. As seen, the arc of the peripheral surface 56*a*' approximates a slope of about 45° relative to the axis of rotation of the first upper wheel 56'. Thus, the peripheral surface 56' of the first upper wheel could, alternatively be flat and sloped and define an angle of about 45° relative to the axis of rotation of the first upper wheel 56'. The second upper wheels 58 are generally identical to the second upper wheels 58 of the trolley 16. However, the upper wheel bracket 46' includes a semi-circular recess 46*c*' extending into the upper surface 46*a*' and which opens to the inner surface 46*b*'. The second upper wheels 58 are rotatably mounted in the recesses 46*c*' of the bracket 46' and are generally perpendicular to the axis A of the trolley 16' and to the flange 18*b* of the track.

Figure 18:
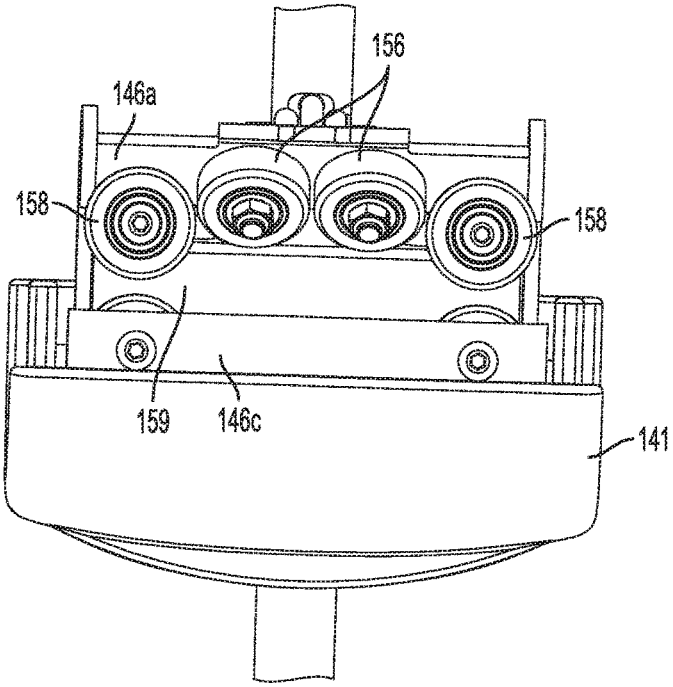
FIG. 18 is a top plan view of the trolley of FIG. 16, with a portion of the housing removed to show the trolley frame.
Figure 19:
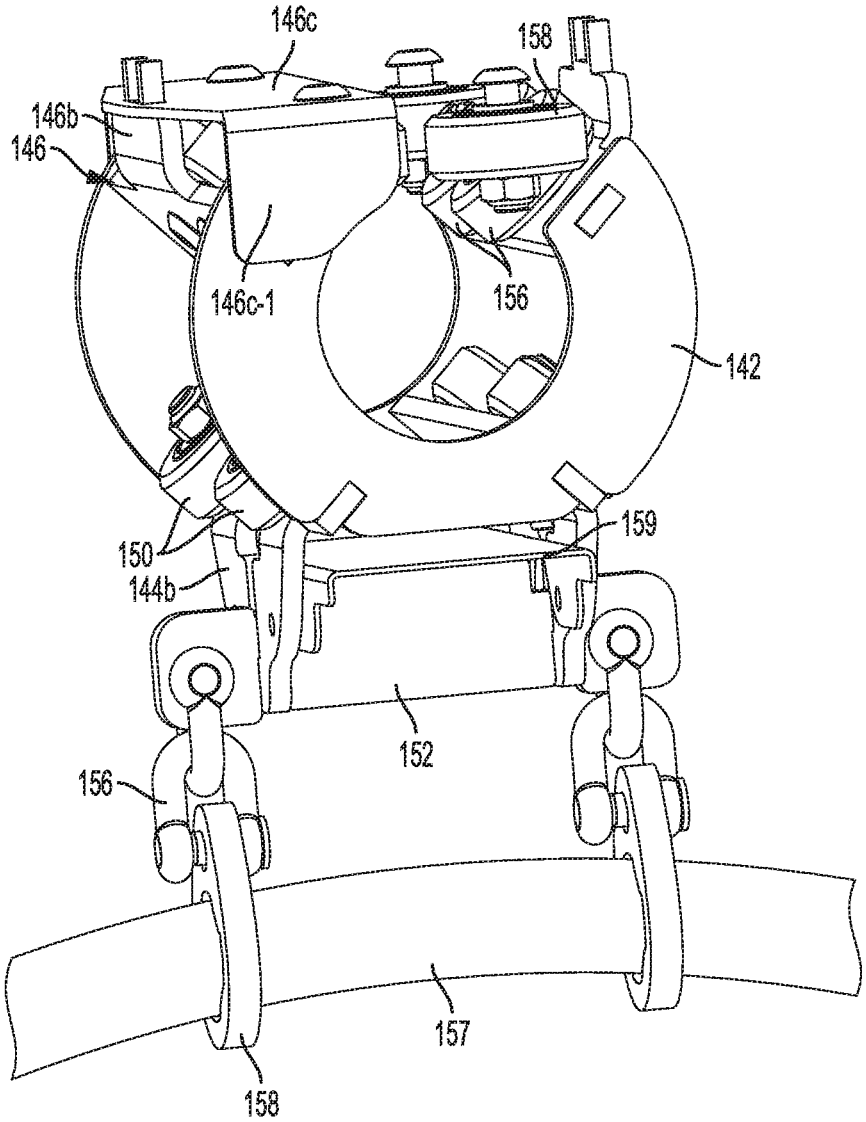
FIG. 19 is a front perspective view of the frame of the trolley of FIG. 16.
Figure 20:
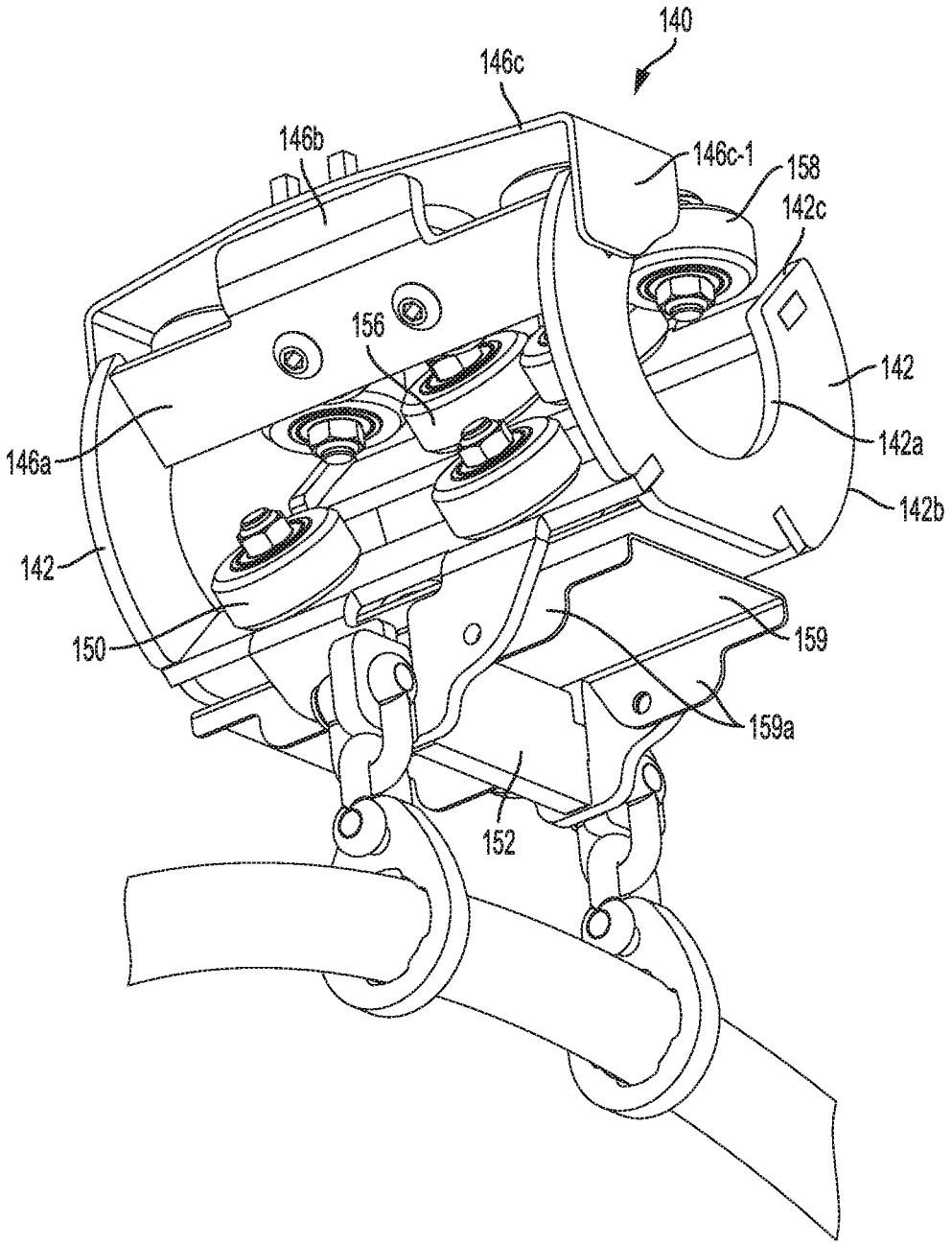
FIG. 20 is a bottom perspective view of the frame of the trolley of FIG. 16.
Figure 21:
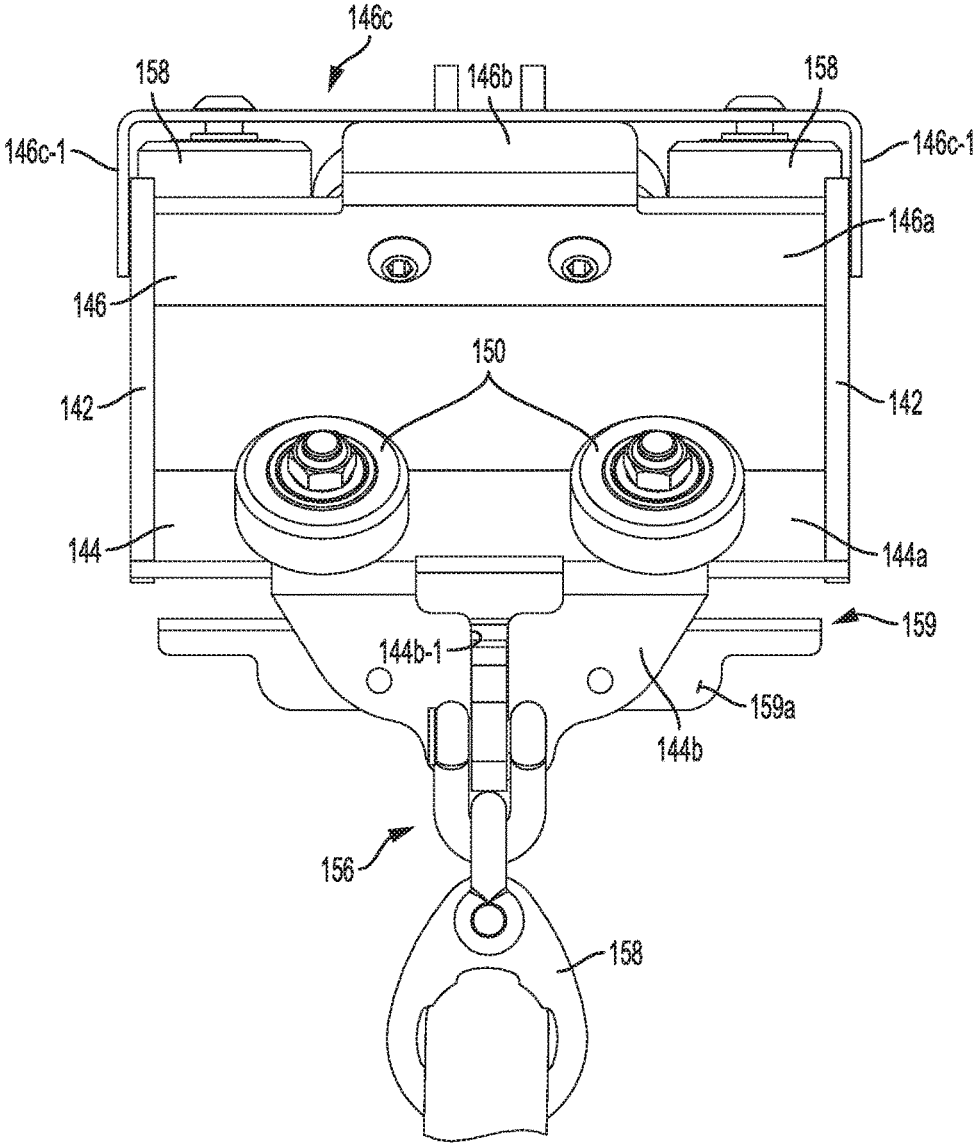
FIG. 21 is a side elevational view of the frame of the trolley of FIG. 16.
Figure 22:
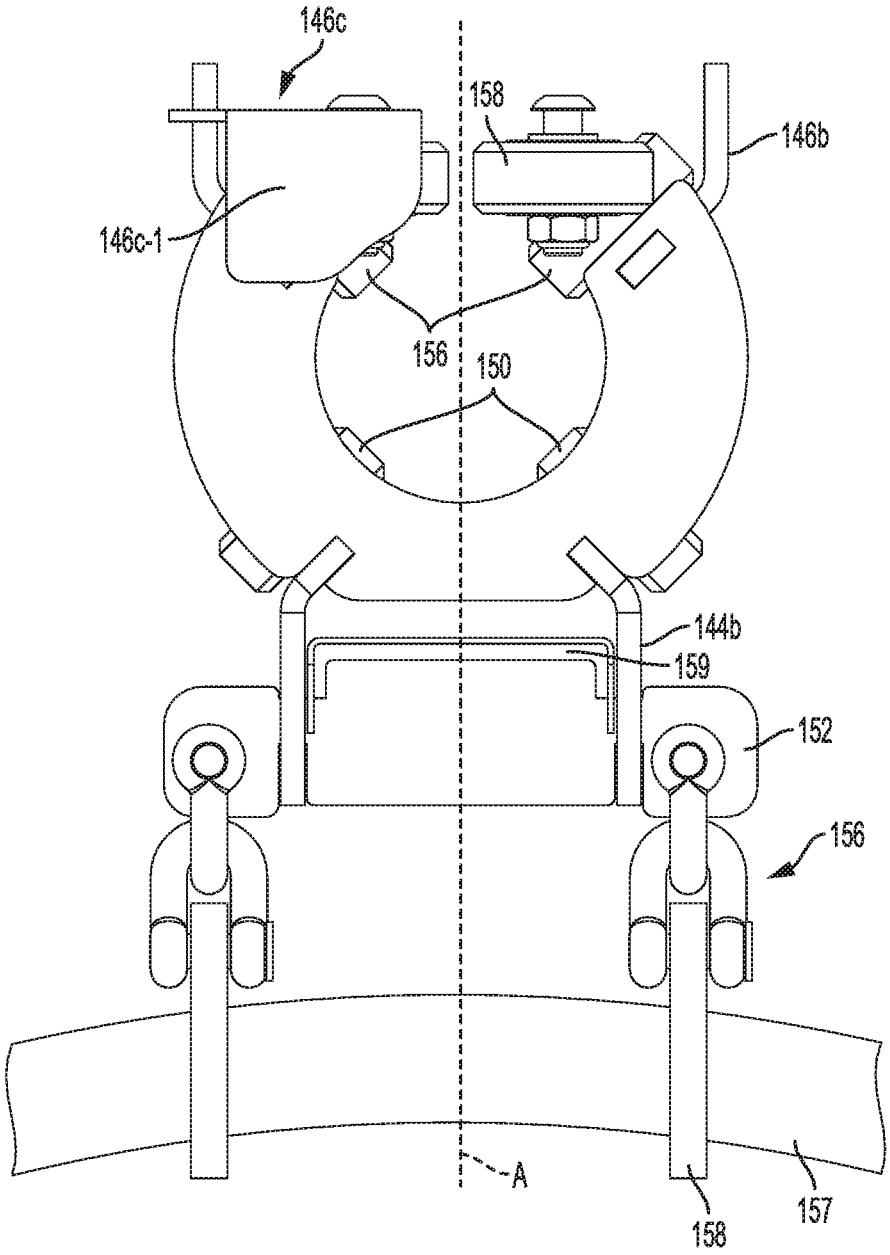
FIG. 22 is a front elevational view of the frame of the trolley of FIG. 16 with a second wheel plate removed for illustrative purposes.
Figure 23:
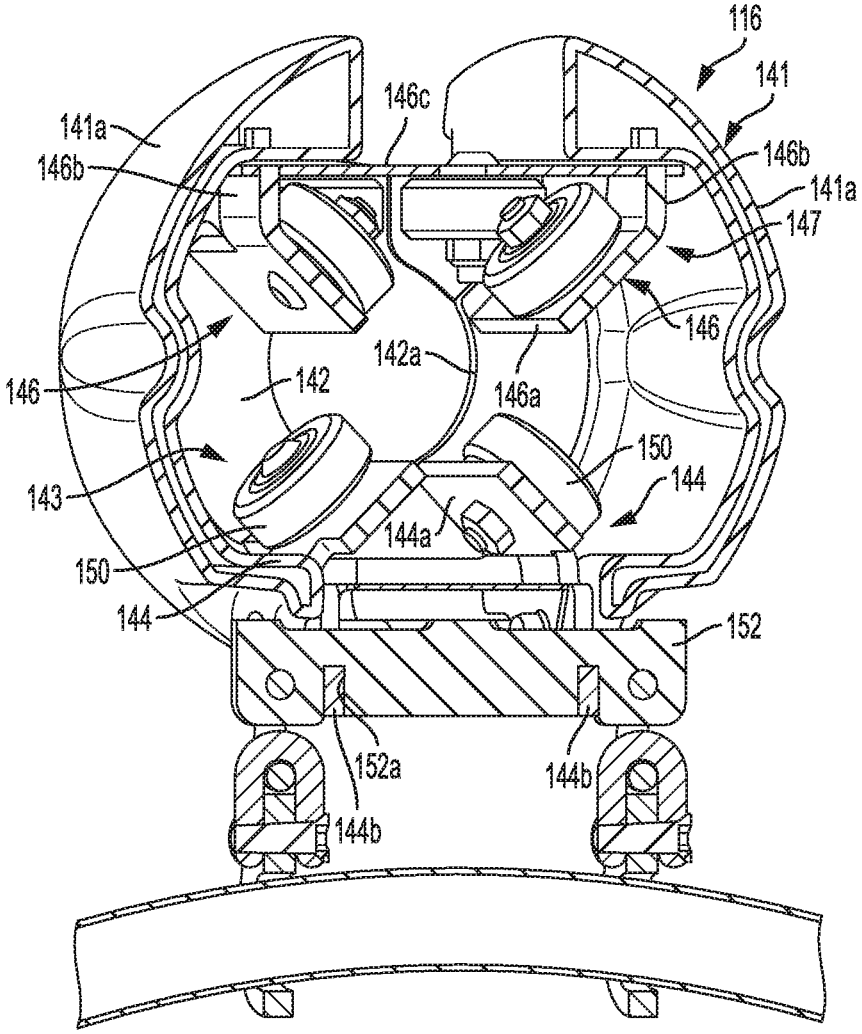
FIG. 23 is a perspective, cross-sectional view of the trolley of FIG. 16 taken along a plane perpendicular to the direction of travel of the trolley.
Figure 24:
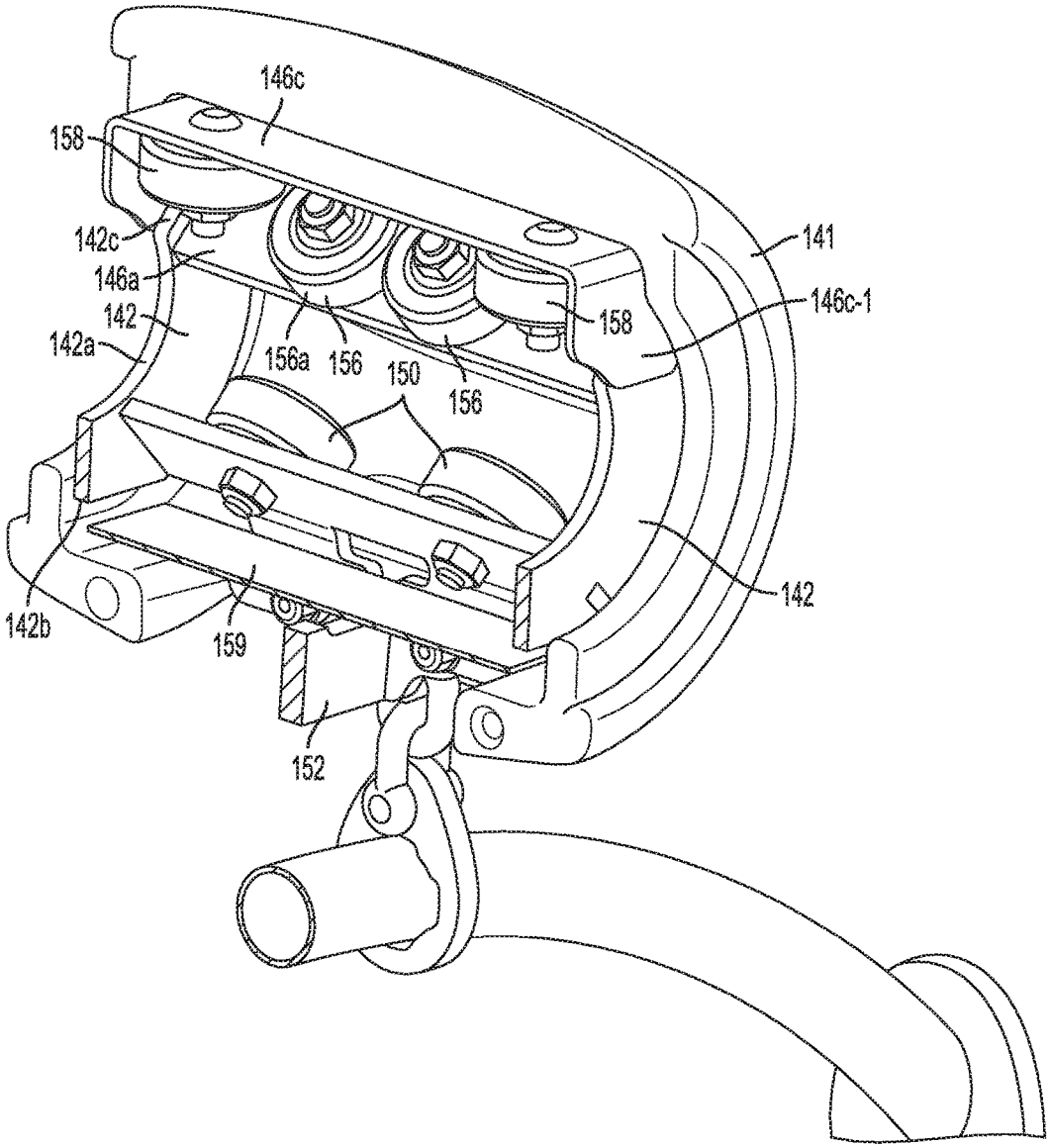
FIG. 24 is a perspective, cross-sectional view of the trolley of FIG. 16 taken along a vertical plane parallel to the direction of travel of the trolley.

Another illustrative embodiment of the trolley is shown in FIGS. 16-24. In this embodiment, the trolley 116 has a frame 140 surrounded by a housing 141. The housing 141 is formed from two housing half shells 141*a* which are secured to the frame 140. The housing shells 141*a*, in combination, define a housing which, as seen in FIG. 15, is generally circular in end view. As seen in FIG. 18, in top plan, the housing 141 has an arcuate side wall, giving the housing a generally barrel shape.

As with the frames 40 and 40', the frame 140 comprises two end plates 142 spaced apart by a lower wheel mount 143 and an upper wheel mount 147. The lower wheel mount 143 is comprised of two lower wheel brackets 144 and the upper wheel mount 147 is comprised of two upper wheel brackets 146. The end plates 142 have inner and outer edges 142*a*, 142*b*, respectively, and end edges 142*c*. The inner edges 142*a* of the end plates are shaped complimentarily to the shape of the track segment run portion 18*a* so as to define a gap of substantially constant size between the track run and the plate inner edge. The end plates 42 do not fully surround the track run 18*a*, but extend more than half-way around the run. Thus, for example, the inner edge 42*a* defines an arc of between about 250° and 300°, and preferably about 270°. The outer edge 142*b* of the end plate is shown to be concentric with the inner surface 142*a*. However the outer edge 142*b* could have any desired shape.

The lower wheel brackets 144 each have wheel plate 144*a* which extends between the two end plates 142. The wheel plates 144*a* are angled relative to a vertical axis A of the frame 140, and can define an angle of between about 30° and 60°, and preferably about 45°, relative to the vertical axis A of the trolley. Two lower wheels 150 are rotatably mounted to each wheel plate 144*a*. The lower wheels 150 are sized, as seen, to extend beyond the upper edge of the wheel plate which is proximate the track run 18*a*.

A rider support S, such as a flexible seat, can be suspended from the trolley in any desired manner. In the trolley 116, a flange 144*b* extends downwardly from each wheel plate 144*a*. As seen, the flanges 144*b* are generally vertical (i.e., generally parallel to the axis A) and define a slot 144*b*-1 which is also generally perpendicular to the axis A of the trolley. A bar 152 extends between the two flanges 144*b* and is received in the slots 144*b*-1 of the flanges 144*b*. The bar 152 has slots 152*b* that are positioned on the bar to be received in the slots 144*b*-1 of the flanges 144*b*. A support bar 157 is suspended below the trolley bar 152 by means of a pair of linked U-brackets 156 and a disk 158 which is suspended from the U-brackets. The support bar 157 passes through openings in the disks 158. The seat S is suspended from the bar 157 by means of a flexible members (i.e., ropes, chains, cords, etc.) suspended from opposite ends of the bar 157. The bar 157 extends beyond the sides of the trolley. The mounting of the bar 157 from the trolley 116 allows for the bar to sway side-to-side relative to the trolley and back-and-forth relative to the trolley. Further, the bar 157 can rotate relative to the disks 158.

The upper wheel brackets 146 similarly extend between the end plates 142. The upper wheel brackets 146 each have a first wheel plate 146*a* which extends between the two end plates 142. The first wheel plates 146*a* are angled relative to a vertical axis A of the frame 140, and can define an angle of between about 30° and 60°, and preferably about 45°, relative to the vertical axis A. First upper wheels 156 are rotatably mounted to each first upper wheel plate 146*a*, and include a generally flat peripheral surface 156*a* which defines a cylinder. The first upper wheels 156 are sized, as seen, to extend beyond the lower edge of the first upper wheel plates. In use, the first upper wheels will ride on the track run and will support the weight of the rider. Therefore, the trolley preferably includes more than one first upper wheel 156. Two first upper wheels 156 are shown, but more could be used if desired. A wall 146*b* extends upwardly from each wheel plate 146*a* such that the wall 146*b* is generally parallel to the vertical axis A (and thus to the track flange 18*b*). A second upper wheel plate 146*c* is mounted to the wall 146*b* and extends inwardly from the wall 146*b* toward the track flange 18*b*. As shown, the second wheel plate 146*c* is generally perpendicular to the axis A. The second upper wheel plate 146*c* includes end members 146*c*-1 which extend downwardly from the ends of the plate 146*c* against the outer surface of the frame end members 142. Thus, the end members 142 are effectively sandwiched between the first wheel plates 146*a* and the second wheel plate end members 146*c*-1. A pair of upper wheels 158 is rotatably mounted to the second wheel plate 146*c*. The second wheels 158 are sized to extend beyond the inner end of the second wheel plate 146*c*, such that, if the trolley rotates about the track run 18*a*, the second upper wheels will engage or ride on the track flange 18*b* to thereby prevent more than a determined amount of rotation of the trolley about the track 18. As seen, the first upper wheels 156 and second upper wheels 158 are arranged such that the first upper wheels 156 are surrounded by the second upper wheels 158. The relative arrangement of the lower and upper wheels could be altered, if desired, such that the upper wheels are surrounded by the lower wheels, or such that the wheels alternate along the length of the upper wheel bracket.

A plate 159 extends between the flanges 144*b* above the bar 152. The plate 159 is provided with side flanges 159*a* which are bolted (or otherwise secured) to the flanges 144*b* to secure the plate 159 in place on the trolley 116. The plate 159 extends substantially the length of the trolley frame 140 and the width of the trolley frame between the flanges 144*b*. As such, the plate 159 will close the bottom of the trolley 116. When the housing 141 is mounted to the frame 140, there may be a gap between the housing shell halves. The plate 159 will thus close this gap at the bottom of the housing to reduce the possibility of riders from getting fingers caught in the frame.

In use, a rider will be suspended from the trolley 16, 16', 116 and will be moved along the track 12. As noted above, the primary contact between the trolley and the track will be by the first upper wheels 56, 56', 156 which ride on an upper portion of the track run 18*a*. When the trolley travels over the top of a "hill" in the track, if due to momentum the first upper wheels 56, 56', 156 disengage from the track run 18*a*, the lower wheels 50, 150 will engage the underside of the track run 18*a*. Hence, the vertical movement of the trolley 16, 16', 116 relative to the track 12 is limited. Further, the interaction of the track flange 18*b* and the second upper wheels 58, 58', 158 will limit the degree to which the trolley 16, 16', 116 can rotate about the track run 18*a*. These limits in the vertical (or radial) and rotational movement of the trolley relative to the track contributes to a smoother ride for the rider.

Additionally, as noted above, the connections between the track segments 18 are tight or rigid, such that adjacent track segments are substantially fixed in alignment relative to each other and such that there will be substantially no movement of one track section relative to an adjacent track section. Further, the connector 20 provides a smooth connection between adjacent track segments 18, such that the transition of the trolley from one track segment 18 to another will be substantially smooth. Therefore, there will be substantially no gaps between track segments that will interfere with the travel of the trolley along the track.

As can be seen from the foregoing, a zip line assembly is disclosed in which the track is formed from rigidly connected track segment and can be formed to substantially any desired pattern. The zip line trolley is designed to facilitate easy travel over the track, yet substantially limit the degree to which the trolley can rotate relative to the track and to limit the degree to which the trolley can become disengaged from the track.

As various changes could be made in the above constructions without departing from the scope of the invention, it is intended that all matter contained in the above description or shown in the accompanying drawings shall be interpreted as illustrative and not in a limiting sense. For example, because the lower wheels are not weight bearing wheels, the trolley could be constructed with a single lower wheel bracket, rather than two lower wheel brackets. In this instance, the single lower wheel bracket would be a plate formed and positioned such that the plane of the lower wheel is generally aligned with the axis A of the trolley, and the rotational axis of the lower wheel is generally perpendicular to the axis A. Although the track run 18*a* is shown as a tube, it could be formed in other manners as well. For example, the run 18*a* could be a generally flat member defining grooves or channels in which the upper wheels ride. These examples are merely illustrative.

The invention claimed is:

1. A zip line comprising:

a substantially rigid track supported above a ground surface by a plurality of supports; said track being comprised of a plurality of track segments connected together such that adjacent track segments have substantially no freedom of movement relative to each other, and such that a junction between adjacent track segments presents a substantially smooth, continuous, and uninterrupted surface; each said track segment comprising a run and a flange extending from an upper portion of said run; and a trolley adapted to move along said track; said trolley comprising a frame having upper wheel mounts and at least one lower wheel mount; each said upper wheel mount including a first wheel surface to which at least one first upper wheel is rotatably mounted and a second wheel surface to which at least one second upper wheel is rotatably mounted; said first wheel surface being oriented such that said first upper wheel engages an upper surface of said track run and said second surface is oriented such that said second upper wheel will engage said track flange upon rotational movement of said trolley relative said track run; said at least one lower wheel mount comprising a lower wheel surface having at least one lower wheel rotatably mounted thereto; said lower wheel having a circumferential surface facing said track run and being slightly spaced from said track run when said first upper wheels are in engagement with said track run; and a rider support suspended from said trolley.

2. The zip line of claim 1 wherein said first wheel surface defines an angle of between about 0° and about 60° relative to a vertical axis of the trolley.

3. The zip line of claim 2 wherein each said upper wheel mount comprises an upper wheel bracket, wherein said first wheel surface is defined by a first upper wheel plate and second wheel surface is defined by a second upper wheel plate.

4. The zip line of claim 3 wherein said second upper wheel plate is substantially perpendicular to a vertical axis of said trolley.

5. The zip line of claim 3 wherein said first upper wheels have generally flat circumferential surfaces, and wherein said first upper wheel plate defines an angle of between about 30° and about 60° relative to a vertical axis of the trolley.

6. The zip line of claim 1 wherein said first upper wheels are generally parallel to said vertical axis of said trolley; said first upper wheels having a peripheral surface which is generally angled relative to the axis of said trolley.

7. The zip line of claim 6 wherein said peripheral surface of said first upper wheels define a concave arch having a curvature which corresponds generally to a curvature of the track run.

8. The zip line of claim 6 wherein said upper wheel mounts are defined by a block.

9. The zip line of claim 1 wherein said at least one lower wheel mount includes first and second lower brackets; said lower wheel surface comprising a lower wheel plate on each of said first and second lower brackets; each said lower wheel having a circumferential surface facing said track run and being slightly spaced from said track run when said first upper wheels are in engagement with said track run.

10. The zip line of claim 1 wherein said lower wheel mount comprises a block.

11. The zip line of claim 1 wherein said lower wheel mount surfaces define an angle of between about 30° and about 60° relative to a vertical axis of the trolley.

12. The zip line of claim 1 wherein said rider support is suspended from said lower wheel mount.

13. The zip line of claim 12 wherein said trolley includes a plate extending between a pair of downwardly extending flanges, and said rider support is suspended from said plate, wherein said plate extends generally perpendicular to the direction of travel of said trolley.

14. A zip line comprising:

a substantially rigid track supported above a ground surface by a plurality of supports; said track being comprised of a plurality of track segments connected together such that adjacent track segments have substantially no freedom of movement relative to each other, and such that a junction between adjacent track segments presents a substantially smooth, continuous, and uninterrupted surface; each said track segment comprising a run and a flange extending from an upper portion of said run; and a trolley adapted to move along said track; said trolley comprising a frame having upper wheel mounts and at least one lower wheel mount; each said upper wheel mount including a first wheel surface to which at least one first upper wheel is rotatably mounted and a second wheel surface to which at least one second upper wheel is rotatably mounted; said first wheel surface being oriented such that said first upper wheel engages an upper surface of said track run and said second surface is oriented such that said second upper wheel will engage said track flange upon rotational movement of said trolley relative said track run; said at least one lower wheel mount comprising a lower wheel surface having at least one lower wheel rotatably mounted thereto; said lower wheel having a circumferential surface facing said track run and being slightly spaced from said track run when said first upper wheels are in engagement with said track run; and a rider support suspended from a bar suspended from said trolley; said bar being generally perpendicular to the axis of said trolley and having a length greater than a width of the trolley.

15. The zip line of claim 14 wherein said trolley lower wheel mount includes a pair of flanges extending downwardly from said bracket, and said bar is mounted to extend through said flanges.

16. The zip line of claim 14 wherein said trolley includes a bar connector pivotally connected to said trolley lower wheel mount; said lower wheel mount comprising a downwardly extending flange, and said connector comprises a body which receives said bar and at least one flange extending up from said body, whereby said connector flange and said mount flange are pivotally connected together.

17. The zip line of claim 16 wherein said bar pivots relative to said trolley in a plane generally perpendicular to the direction of travel of said trolley.

18. The Zip line of claim 14 wherein said trolley includes a bar connector mounted between the flanges of said lower wheel mounts; said bar being swingingly suspended from said bar connector.

19. A zip line comprising:

a substantially rigid track supported above a ground surface by a plurality of supports; said track being comprised of a plurality of track segments connected together such that adjacent track segments have substantially no freedom of movement relative to each other, and such that a junction between adjacent track segments presents a substantially smooth, continuous, and uninterrupted surface; each said track segment comprising a run and a flange extending from an upper portion of said run; wherein said track segment runs are hollow at least at opposite ends of the track segment run; said connector comprising a body have an outer surface sized and shaped correspondingly to the hollow ends of said track segment runs such that said connector can be snuggly received in said hollow ends of said track segment run; said connector further including a flange extending about said body; said flange having a width approximately equal to the thickness of the hollow ends of said track segment run; whereby, when said track is assembled, end surfaces of said track segment runs substantially abut opposite sides of said connector flange;

a trolley adapted to move along said track; said trolley comprising a frame having upper wheel mounts; each said upper wheel mount including a first wheel surface to which at least one first upper wheel is rotatably mounted and a second wheel surface to which at least one second upper wheel is rotatably mounted; said first wheel surface being oriented such that said first upper wheel engages an upper surface of said track run and said second surface is oriented such that said second upper wheel will engage said track flange upon rotational movement of said trolley relative said track run; and a rider support suspended from said trolley.

20. The zip line of claim 1 wherein said track supports comprise a main support member comprising a generally vertical section extending upwardly from the ground and a generally horizontal section connected to said generally vertical section; said track being suspended from said generally vertical section such that said track is below said generally vertical section of said support.

21. The zip line of claim 20 wherein said generally vertical and horizontal sections of said main support are connected by a curved section.

22. The zip line of claim 20 wherein said supports further comprise a second generally vertical leg spaced from said generally vertical section of said main support, said second generally vertical leg extending upwardly from the ground to engage said main support.

23. The zip line of claim 1 wherein said support includes a track mounting bracket and at least selective of said track segments include a track mounting portion; said mounting bracket and track segment mounting portion having holes positioned to be aligned, whereby said track segments are connected to said bracket by means of fasteners.

24. The zip line of claim 1 wherein said track includes a stop at at least one end thereof.

25. The zip line of claim 1 wherein said track segments are formed to be straight, curving left, curving right, curving up or curving down.

26. A trolley adapted to move along a track of a zip line, said trolley comprising a frame which is generally symmetrical about a vertical center plane and a rider support suspended from said trolley; said frame having upper wheel mounts on opposite sides of said center plane and at least one lower wheel mount;

each said upper wheel mount including a first wheel surface to which at least one first upper wheel is rotatably mounted and a second wheel surface to which at least one second upper wheel is rotatably mounted; said first wheel surface defining an angle of between about 0° and about 60° relative to said vertical center plane; and said second surface is oriented such that said at least one second upper wheel will rotate in a plane that is generally perpendicular (within about 10°) to said vertical center plane; and, said at least one lower wheel mount comprising a lower wheel surface having at least one lower wheel rotatably mounted thereto; said lower wheel having a circumferential surface facing said track run and being slightly spaced from said track run when said first upper wheels are in engagement with said track run.

27. The trolley of claim 26 wherein each said upper wheel mount comprises an upper wheel bracket, wherein said first wheel surface is defined by a first upper wheel plate and second wheel surface is defined by a second upper wheel plate.

28. The trolley of claim 27 wherein said first upper wheels have generally flat peripheral surfaces which define a cylinder, and wherein said first upper wheel plate defines an angle of between about 30° and about 60° relative to a vertical axis of the trolley.

29. The trolley of claim 26 wherein said first upper wheels are generally parallel to said vertical axis of said trolley; said first upper wheels having a peripheral surface which is generally angled relative to the axis of said trolley.

30. The trolley of claim 29 wherein said peripheral surface of said first upper wheels define a concave arch.

31. The trolley of claim 29 wherein said upper wheel mounts are defined by a block.

32. The trolley of claim 26 wherein said trolley further includes at least one lower wheel mount comprising a lower wheel surface having at least one lower wheel rotatably mounted thereto; said lower wheel having a circumferential surface facing vertical center plane.

33. The trolley of claim 32 wherein said at least one lower wheel mount includes right and left lower brackets; said lower wheel surface comprising a lower wheel plate on each of said left and right brackets; each said lower wheel having a circumferential surface facing vertical center planes.

34. The trolley of claim 32 wherein said lower wheel mount comprises a block.

35. The trolley of claim 32 wherein said lower wheel mount surfaces define an angle of between about 30° and about 60° relative to said vertical center plane.

36. The trolley of claim 32 wherein said rider support is suspended from said lower wheel mount.

37. The trolley of claim 36 wherein said trolley includes a plate extending between a pair of downwardly extending flanges, and said rider support is suspended from said plate, wherein said plate extends generally perpendicular to the direction of travel of said trolley.

38. A trolley adapted to move along a track of a zip line, said trolley comprising:

a frame which is generally symmetrical about a vertical center plane;

upper wheel mounts on said frame on opposite sides of said center plane; each said upper wheel mount including a first wheel surface to which at least one first upper wheel is rotatably mounted and a second wheel surface to which at least one second upper wheel is rotatably mounted; said first wheel surface defining an angle of between about 0° and about 60° relative to said vertical center plane; and said second surface is oriented such that said at least one second upper wheel will rotate in a plane that is generally perpendicular (within about 10°) to said vertical center plane;

at least one lower wheel mount comprising a lower wheel surface having at least one lower wheel rotatably mounted thereto; said lower wheel having a circumferential surface facing vertical center plane; and a rider support suspended from a bar suspended from said trolley; said bar being generally perpendicular to the axis of said trolley and having a length greater than a width of the trolley.

39. The trolley of claim 38 wherein said trolley lower wheel mount includes a pair of flanges extending downwardly from said bracket, and said bar extends through said flanges.

40. The trolley of claim 38 wherein said trolley includes a bar connector pivotally connected to said trolley lower wheel mount; said lower wheel mount comprising a downwardly extending flange, and said connector comprises a body which receives said bar and at least one flange extending up from said body, whereby said connector flange and said mount flange are pivotally connected together.

41. The trolley of claim 38 wherein said bar pivots relative to said trolley in a plane generally perpendicular to the direction of travel of said trolley.

42. The trolley of claim 38 wherein said trolley includes a bar connector mounted between the flanges of said lower wheel mounts; said bar being swingingly suspended from said bar connector.

* * * * *